US006579842B2

(12) United States Patent
Howell et al.

(10) Patent No.: US 6,579,842 B2
(45) **Date of Patent: *Jun. 17, 2003**

(54) METHOD OF TREATING FABRICS

(75) Inventors: Steven Howell, Shambrook (GB); Julie Little, Shambrook (GB); Cornelis Paul Van Der Logt, Vlaardingen (NL); Neil James Parry, Shambrook (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 25 days.

This patent is subject to a terminal disclaimer.

(21) Appl. No.: 09/742,693

(22) Filed: Dec. 20, 2000

(65) Prior Publication Data

US 2002/0019324 A1 Feb. 14, 2002

(30) Foreign Application Priority Data

Dec. 22, 1999 (EP) ..... 99310431

(51) Int. Cl.[7] ..... C12S 9/00; C11D 7/18; C11D 17/08

(52) U.S. Cl. ..... 510/392; 510/119; 510/122; 510/130; 510/138; 510/137; 510/141; 510/151; 510/158; 510/159; 510/372; 510/383; 510/286; 510/299; 510/300; 510/302; 510/303; 510/305; 510/308; 510/393; 510/374; 510/394; 510/375; 510/379; 510/380

(58) Field of Search ..... 510/119, 122, 510/130, 138, 137, 141, 151, 158, 159, 372, 383, 286, 299, 300, 302, 303, 305, 308, 392, 393, 374, 394, 375, 380, 379

(56) References Cited

U.S. PATENT DOCUMENTS

| | | | | |
|---|---|---|---|---|
| 5,190,661 A | | 3/1993 | Bruening et al. | 210/670 |
| 5,500,153 A | | 3/1996 | Figueroa et al. | 252/548 |
| 5,652,206 A | | 7/1997 | Bacon et al. | 510/101 |
| 5,686,014 A | | 11/1997 | Baillely et al. | 252/186.33 |
| 5,912,157 A | * | 6/1999 | von der Osten et al. | 435/209 |
| 5,935,271 A | * | 8/1999 | Lappas et al. | 8/137 |
| 6,218,350 B1 | * | 4/2001 | Beggs et al. | 510/305 |

FOREIGN PATENT DOCUMENTS

| | | |
|---|---|---|
| DE | 195 36 714 | 4/1997 |
| DE | 196 21 224 | 11/1997 |
| EP | 0 385 529 | 9/1990 |
| WO | 94/25591 | 11/1994 |
| WO | 95/02675 | 1/1995 |

(List continued on next page.)

OTHER PUBLICATIONS

PCT International Search Report in a PCT application PCT/EP 00/12531 Aug. 12, 2000.

(List continued on next page.)

*Primary Examiner*—Yogendra N. Gupta
*Assistant Examiner*—Preeti Kumar
(74) *Attorney, Agent, or Firm*—Rimma Mitelman

(57) ABSTRACT

A method of delivering a benefit agent to fabric for exerting a pre-determined activity, wherein the fabric is pre-treated with a multi-specific binding molecule which has a high binding affinity to the fabric through one specificity and is capable of binding to the benefit agent through another specificity, followed by contacting the pre-treated fabric with the benefit agent, to enhance the pre-determined activity to the fabric. Preferably, the binding molecule is an antibody or fragment thereof, or a fusion protein comprising a cellulose binding domain and a domain having a high binding affinity to another ligand which is directed to said benefit agent. The method is useful for example for stain removal, perfume delivery, and treating collars and cuffs for wear.

21 Claims, 12 Drawing Sheets

Nucleotide and amino acid sequence of the HindIII/EcoRI insert of plasmid Fv4715-myc encoding pelB leader-VH4715 and pelB leader-VL4715.

FOREIGN PATENT DOCUMENTS

| | | | |
|---|---|---|---|
| WO | 95/09909 | | 4/1995 |
| WO | 98/00500 | | 1/1998 |
| WO | 98/01523 | | 1/1998 |
| WO | 98/0720 | | 2/1998 |
| WO | 98/06812 | | 2/1998 |
| WO | 98/23716 | | 6/1998 |
| WO | WO 98/23716 | * | 6/1998 |
| WO | 98/56885 | | 12/1998 |
| WO | 99/02693 | | 1/1999 |
| WO | 99/12624 | | 3/1999 |
| WO | 99/23221 | | 5/1999 |
| WO | 99/36469 | | 7/1999 |
| WO | 99/57154 | | 11/1999 |
| WO | WO 99/57154 | * | 11/1999 |
| WO | 99/57155 | | 11/1999 |
| WO | 99/57250 | | 11/1999 |
| WO | 00/18864 | | 4/2000 |
| WO | 00/36094 | | 6/2000 |
| WO | 01/07555 | | 2/2001 |
| WO | 01/1669 | | 3/2001 |

OTHER PUBLICATIONS

PCT International Search Report in a PCT application PCT/EP 00/12529, Aug. 12, 2000.

Co–pending application: Davis et al.; Ser. No. 09/742,690; filed—Dec. 20, 2000.

Co–pending application: Hemington et al.; Ser. No. 09/742, 694; Filed—Dec. 20, 2000.

Co–pending application: Howell et al.; Ser. No. 09/472,689; Filed—Dec. 20, 2000.

Co–pending application; Antheunisse et al.; Ser. No. 09/742, 692; Filed—Dec. 20, 2000.

Co–pending application; Berry et al.; Ser. No. 09/712,561; Filed—Nov. 14, 2000.

Derwent Abstract of DE 196 21 224, Nov. 27, 1997.

PCT International Search Report in a PCT application PCT/EP 00/12532, Aug. 12, 2000.

PCT International Search Report in a PCT application PCT/EP 00/12530, Aug. 12, 2000.

PCT International Search Report in a PCT application PCT/EP 00/12531, Aug. 12, 2000.

PCT International Search Report in a PCT application PCT/EP 00/12523, Aug. 12, 2000.

Derwent Abstract of JP 10 174583—Jun. 30, 1998.

* cited by examiner pelB leader

M K Y L L P T
AAGCTTGCATGCAAATTCTATTTCAAGGAGACAGTCATAATGAAATACCTATTGCCTACG

A A A G L L L L A A Q P A M A Q V Q L Q
GCAGCCGCTGGATTGTTATTACTCGCTGCCCAACCAGCGATGGCCCAGGTGCAGCTGCAG

E S G G D L V K P G G S L T L S C A T S
GAGTCAGGGGGAGACTTAGTGAAGCCTGGAGGGTCCCTGACACTCTCCTGTGCAACCTCT

G F T F S S Y A F S W V R Q T S D K S L
GGATTCACTTTCAGTAGTTATGCCTTTTCTTGGGTCCGCCAGACCTCAGACAAGAGTCTG

VH4715

E W V A T I S S T D T Y T Y Y S D N V K
GAGTGGGTCGCAACCATCAGTAGTACTGATACTTATACCTATTATTCAGACAATGTGAAG

G R F T I S R D N G K N T L Y L Q M S S
GGGCGCTTCACCATCTCCAGAGACAATGGCAAGAACACCCTGTACCTGCAAATGAGCAGT

L K S E D T A V Y Y C A R H G Y Y G K G
CTGAAGTCTGAGGACACAGCCGTGTATTACTGTGCAAGACATGGGTACTATGGTAAAGGC

Y F D Y W G Q G T T V T V S S
TATTTTGACTACTGGGGCCAAGGGACCACGGTCACCGTCTCCTCATAATAAGAGCTATGG pelB leader

M K Y L L P T
GAGCTTGCATGCAAATTCTATTTCAAGGAGACAGTCATAATGAAATACCTATTGCCTACG

A A A G L L L L A A Q P A M A D I E L T
GCAGCCGCTGGATTGTTATTACTCGCTGCCCAACCAGCGATGGCCGACATCGAGCTCACT

Q S P F S L T V T A G E K V T M N C K S
CAGTCTCCATTCTCCCTGACTGTGACAGCAGGAGAGAAGGTCACTATGAATTGCAAGTCC

G Q S L L N S V N Q R N Y L T W Y Q Q K
GGTCAGAGTCTGTTAAACAGTGTAAATCAGAGGAACTACTTGACCTGGTACCAGCAGAAG

VL4715

P G Q P P K L L I Y W A S T R E S G V P
CCAGGGCAGCCTCCTAAACTGTTGATCTACTGGGCATCCACTAGGGAATCTGGAGTCCCT

D R F T A S G S G T D F T L T I S S V Q
GATCGCTTCACAGCCAGTGGATCTGGAACAGATTTCACTCTCACCATCAGCAGTGTGCAG

A E D L A V Y Y C Q N D Y T Y P F T F G
GCTGAAGACCTGGCAGTTTATTACTGTCAGAATGATTATACTTATCCGTTCACGTTCGGA

Myc-tag

G G T K L E I K R E Q K L I S E E D L N
GGGGGGACCAAGCTCGAGATCAAACGGGAACAAAAACTCATCTCAGAAGAGGATCTGAAT

TAATAAGATCAAACGGTAATAAGGATCCAGCTCGAATTC

Figure 1 Nucleotide and amino acid sequence of the HindIII/ EcoRI insert of plasmid Fv4715-myc encoding pelB leader-VH4715 and pelB leader-VL4715.

```
                                                M  K  Y  L  L  P  T
pelB      AAGCTTGCATGCAAATTCTATTTCAAGGAGACAGTCATAATGAAATACCTATTGCCTACG
leader
           A  A  A  G  L  L  L  L  A  A  Q  P  A  M  A [Q  V  Q  L  Q]
          GCAGCCGCTGGATTGTTATTACTCGCTGCCCAACCAGCGATGGCCCAGGTGCAGCTGCAG

          [E  S  G  G  D  L  V  K  P  G  G  S  L  T  L  S  C  A  T  S]
          GAGTCAGGGGGAGACTTAGTGAAGCCTGGAGGGTCCCTGACACTCTCCTGTGCAACCTCT

          [G  F  T  F  S  S  Y  A  F  S  W  V  R  Q  T  S  D  K  S  L]
          GGATTCACTTTCAGTAGTTATGCCTTTTCTTGGGTCCGCCAGACCTCAGACAAGAGTCTG

VH4715    [E  W  V  A  T  I  S  S  T  D  T  Y  T  Y  Y  S  D  N  V  K]
          GAGTGGGTCGCAACCATCAGTAGTACTGATACTTATACCTATTATTCAGACAATGTGAAG

          [G  R  F  T  I  S  R  D  N  G  K  N  T  L  Y  L  Q  M  S  S]
          GGGCGCTTCACCATCTCCAGAGACAATGGCAAGAACACCCTGTACCTGCAAATGAGCAGT

          [L  K  S  E  D  T  A  V  Y  Y  C  A  R  H  G  Y  Y  G  K  G]
          CTGAAGTCTGAGGACACAGCCGTGTATTACTGTGCAAGACATGGGTACTATGGTAAAGGC

          [Y  F  D  Y  W  G  Q  G  T  T  V  T  V  S  S] [G  G  G  G  S]
          TATTTTGACTACTGGGGCCAAGGGACCACGGTCACCGTCTCCTCAGGTGGAGGCGGTTCA
Linker
          [G  G  G  G  S  G  G  G  G  S] [D  I  E  L  T  Q  S  P  F  S]
          GGCGGAGGTGGCTCTGGCGGTGGCGGATCGGACATCGAGCTCACTCAGTCTCCATTCTCC

          [L  T  V  T  A  G  E  K  V  T  M  N  C  K  S  G  Q  S  L  L]
          CTGACTGTGACAGCAGGAGAGAAGGTCACTATGAATTGCAAGTCCGGTCAGAGTCTGTTA

          [N  S  V  N  Q  R  N  Y  L  T  W  Y  Q  Q  K  P  G  Q  P  P]
VL4715    AACAGTGTAAATCAGAGGAACTACTTGACCTGGTACCAGCAGAAGCCAGGGCAGCCTCCT

          [K  L  L  I  Y  W  A  S  T  R  E  S  G  V  P  D  R  F  T  A]
          AAACTGTTGATCTACTGGGCATCCACTAGGGAATCTGGAGTCCCTGATCGCTTCACAGCC

          [S  G  S  G  T  D  F  T  L  T  I  S  S  V  Q  A  E  D  L  A]
          AGTGGATCTGGAACAGATTTCACTCTCACCATCAGCAGTGTGCAGGCTGAAGACCTGGCA

          [V  Y  Y  C  Q  N  D  Y  T  Y  P  F  T  F  G  G  G  T  K  L]
          GTTTATTACTGTCAGAATGATTATACTTATCCGTTCACGTTCGGAGGGGGGACCAAGCTC

Myc-tag   [E  I  K  R] (E  Q  K  L  I  S  E  E  D  L  N)
          GAGATCAAACGGGAACAAAAACTCATCTCAGAAGAGGATCTGAATTAATAAGATCAAACG

          GTAATAAGGATCCAGCTCGAATTC
```

Figure 2 Nucleotide and amino acid sequence of the HindIII/ EcoRI insert of plasmid scFv4715-myc encoding pelB leader-VH4715-linker-VL4715.

M K Y L L P T

AAGCTTGCATGCAAATTCTATTTCAAGGAGACAGTCATAATGAAATACCTATTGCCTACG pelB leader

A A A G L L L L A A Q P A M A Q V Q L Q

GCAGCCGCTGGATTGTTATTACTCGCTGCCCAACCGGCCATGGCCCAGGTGCAGCTGCAG

Q S G A E L V K P G P S V K L S C K A S

CAGTCTGGGGCTGAACTGGTGAAGCCTGGGCCTTCTGTGAAGCTGTCCTGCAAGGCTTCC

D Y T F T S Y W M H W V K Q R P G Q G L

GACTACACCTTCACCAGTTATTGGATGCACTGGGTGAAGCAGAGGCCTGGACAAGGCCTT

VH3299

E W I G E I N P T N G R T Y Y N E K F K

GAGTGGATTGGAGAGATTAATCCTACCAACGGTCGTACTTATTACAATGAGAAGTTCAAG

S K A T L T V D K S S S T A Y M Q L S S

AGCAAGGCCACACTGACTGTAGACAAATCTTCCAGTACAGCCTACATGCAGCTCAGCAGC

L T S E D S A V Y Y C A R R Y G N S F D

CTGACATCTGAGGACTCTGCGGTCTATTACTGTGCAAGACGGTATGGTAACTCCTTTGAC

Y W G Q G T T V T V S S pelB leader

TACTGGGGCCAAGGGACCACGGTCACCGTCTCCTCATAATAAGAGCTATGGGAGCTTGCA

M K Y L L P T A A A

TGCAAATTCTATTTCAAGGAGACAGTCATAATGAAATACCTATTGCCTACGGCAGCCGCT

G L L L L A A Q P A M A D I E L T Q S P

GGATTGTTATTACTCGCTGCCCAACCAGCGATGGCCGACATCGAGCTCACCCAGTCTCCA

D S L A V S L G Q R A T I S C R A S E S

GATTCTTTGGCTGTGTCTCTAGGGCAGAGGGCCACCATATCCTGCAGAGCCAGTGAAAGT

VL3299

V D S Y G N S F M Q W Y Q Q K P G Q P P

GTTGATAGTTATGGCAATAGTTTTATGCAGTGGTACCAGCAGAAACCAGGACAGCCACCC

K L L I Y R A S N L E S G I P A R F S G

AAACTCCTCATCTATCGTGCATCCAACCTAGAATCTGGGATTCCTGCCAGGTTCAGTGGC

T G S R T D F T L T I N P V E A D D V A

ACTGGGTCTAGGACAGACTTCACCCTCACCATTAATCCTGTGGAGGCTGATGATGTTGCA

T Y Y C Q Q S D E Y P Y M Y T F G G G T

ACCTATTATTGTCAACAAAGTGATGAGTATCCGTACATGTACACGTTCGGAGGGGGGACC

Hydrophil-2 tag

K L E I K R G S G S G N S G K G Y L K

AAGCTCGAGATCAAACGGGGATCCGGTAGCGGGAACTCCGGTAAGGGGTACCTGAAGTAA

TAAGATCAAACGGTAATAAGGATCCAGCTCGAATTC

Figure 3 Nucleotide and amino acid sequence of the HindIII/ EcoRI insert of plasmid Fv3299-hydro2 encoding pelB leader-VH3299 and pelB leader-VL3299 with hydrophil2 tail.

```
                                                M  K  Y  L  L  P  T  A
pelB
leader   AAGCTTGCAAATTCTATTTCAAGGAGACAGTCATAATGAAATACCTATTGCCTACGGCAG

         A  A  G  L  L  L  L  A  A  Q  P  A  M  A  Q  V  Q  L  Q  Q
         CCGCTGGATTGTTATTACTCGCTGCCCAACCAGCGATGGCCCAGGTGCAGCTGCAGCAGT

         S  G  P  E  L  V  K  P  G  A  S  V  K  M  S  C  K  A  S  G
         CAGGACCTGAGCTGGTAAAGCCTGGGGCTTCAGTGAAGATGTCCTGCAAGGCTTCTGGAT

         Y  T  F  T  S  Y  V  M  H  W  V  K  Q  K  P  G  Q  G  L  E
         ACACATTCACTAGCTATGTTATGCACTGGGTGAAACAGAAGCCTGGGCAGGGCCTTGAGT
VH3418
         W  I  G  Y  I  Y  P  Y  N  D  G  T  K  Y  N  E  K  F  K  G
         GGATTGGATATATTTATCCTTACAATGATGGTACTAAGTACAATGAGAAGTTCAAAGGCA

         K  A  T  L  T  S  D  K  S  S  S  T  A  Y  M  E  L  S  S  L
         AGGCCACACTGACTTCAGACAAATCCTCCAGCACAGCCTACATGGAGCTCAGCAGCCTGA

         T  S  E  D  S  A  V  Y  Y  C  S  R  R  F  D  Y  W  G  Q  G
         CCTCTGAGGACTCTGCGGTCTATTACTGTTCAAGACGCTTTGACTACTGGGGCCAAGGGA

         T  T  V  T  V  S  S
         CCACGGTCACCGTCTCCTCATAATAAGAGCTATGGGAGCTTGCATGCAAATTCTATTTCA

pelB                     M  K  Y  L  L  P  T  A  A  A  G  L  L  L  L
leader   AGGAGACAGTCATAATGAAATACCTATTGCCTACGGCAGCCGCTGGATTGTTATTACTCG

         A  A  Q  P  A  M  A  D  I  E  L  T  Q  S  P  S  S  M  Y  A
         CTGCCCAACCAGCGATGGCCGACATCGAGCTCACCCAGTCTCCATCTTCCATGTATGCAT

         S  L  G  E  R  I  T  I  T  C  K  A  S  Q  D  I  N  T  Y  L
         CTCTAGGAGAGAGAATCACTATCACTTGCAAGGCGAGTCAGGACATTAATACCTATTTAA

         T  W  F  Q  Q  K  P  G  K  S  P  K  T  L  I  Y  R  A  N  R
VL3418   CCTGGTTCCAGCAGAAACCAGGGAAATCTCCCAAGACCCTGATCTATCGTGCAAACAGAT

         L  L  D  G  V  P  S  R  F  S  G  S  G  S  G  Q  D  Y  S  L
         TGCTAGATGGGGTCCCATCAAGGTTCAGTGGCAGTGGATCTGGGCAAGATTATTCTCTCA

         T  I  S  S  L  D  Y  E  D  M  G  I  Y  Y  C  L  Q  Y  D  E
         CCATCAGCAGCCTGGACTATGAAGATATGGGAATTTATTATTGTCTACAATATGATGAGT

         L  Y  T  F  G  G  G  T  K  L  E  I  K  R
         TGTACACGTTCGGAGGGGGGACCAAGCTCGAGATCAAACGGTAATAATGATCAAACGGT

         ATAAGGATCCAGCTCGAATTC
```

Figure 4 Nucleotide and amino acid sequence of the HindIII/ EcoRI insert of plasmid Fv3418 encoding pelB leader-VH3418 and pelB leader-VL3418.

D I E L T Q S P A S L S A S V G E
GAATTCGGCCGACATCGAGCTCACCCAGTCTCCAGCCTCCCTTTCTGCGTCTGTGGGAGA

T V T I T C R A S G N I H N Y L A W Y Q
AACTGTCACCATCACATGTCGAGCAAGTGGGAATATTCACAATTATTTAGCATGGTATCA

Q K Q G K S P Q L L V Y Y T T T L A D G
GCAGAAACAGGGAAAATCTCCTCAGCTCCTGGTCTATTATACAACAACCTTAGCAGATGG

VL*Lys*

V P S R F S G S G S G T Q Y S L K I N S
TGTGCCATCAAGGTTCAGTGGCAGTGGATCAGGAACACAATATTCTCTCAAGATCAACAG

L Q P E D F G S Y Y C H F W S T P R T F
CCTGCAACCTGAAGATTTTGGGAGTTATTACTGTCAACATTTTTGGAGTACTCCTCGGAC

G G G T K L E I K R G G G G S G G G G S
GTTCGGTGGAACCAAGCTCGAGATCAAACGGGGTGGAGGCGGTTCAGGCGGAGGTGGCTC

Linker

G G G G S Q V Q L Q E S G P G L V A P S
TGGCGGTGGCGGATCGCAGGTGCAGCTGCAGGAGTCAGGACCTGGCCTGGTGGCGCCCTC

Q S L S I T C T V S G F S L T G Y G V N
ACAGAGCCTGTCCATCACATGCACCGTCTCAGGGTTCTCATTAACCGGCTATGGTGTAAA

W V R Q P P G K G L E W L G M I W G D G
CTGGGTTCGCCAGCCTCCAGGAAAGGGTCTGGAGTGGCTGGGAATGATTTGGGGTGATGG

VH*Lys*

N T D Y N S A L K S R L S I S K D N S K
AAACACAGACTATAATTCAGCTCTCAAATCCAGACTGAGCATCAGCAAGGACAACTCCAA

S Q V F L K M N S L H T D D T A R Y Y C
GAGCCAAGTTTTCTTAAAAATGAACAGTCTGCACACTGATGACACAGCCAGGTACTACTG

A R E R D Y R L D Y W G Q G T T V T V S
TGCCAGAGAGAGAGATTATAGGCTTGACTACTGGGGCCAAGGGACCACGGTCACCGTCTC

S
CTCATGATAAGCTT

Figure 5 Nucleotide and amino acid sequence of the HindIII/ EcoRI insert of plasmid pUR4124 encoding pelB leader-VLlys-linker-VHlys.

Figure 7 Bi-head cloning strategy

Figure 8 Alignment of bi-head predicted amino acid sequences. The kabat CDRs, purification and detection tails are boxed, amino acid differences are in bold type.

CAGGTGCAGCTGCAGGAGTCAGGGGGAGGATTGGTGCAGGCTGGGGGCTCTCTGAGACTC
TCCTGTGCAGCCTCGGGACGCGCCACCAGTGGTCATGGTCACTATGGTATGGGCTGGTTC
CGCCAGGTTCCAGGGAAGGAGCGTGAGTTTGTCGCAGCTATTAGGTGGAGTGGTAAAGAG
ACATGGTATAAAGACTCCGTGAAGGGCCGATTCACCATCTCCAGAGATAACGCCAAGACT
ACGGTTTATCTGCAAATGAACAGCCTGAAACCTGAAGATACGGCCGTTTATTATTGTGCC
GCTCGACCGGTCCGCGTGGATGATATTTCCCTGCCGGTTGGGTTTGACTACTGGGGCCAG
GGGACCCAGGTCACCGTCTCCTCACAGGTGCAGCTGCAGCAGTCTGGGGGAGGCTTGGTA
CAGCCTGGGGGGTCTCTAAGACTCTCCTGTGAAGCCTCTGGGTTCATCTTCAGTAGCAGA
GCGATGTCCTGGTATCGCCAGGGTCCAGGGAAGCAGCGCGAGCCGGTCGCATTTATTTCT
ACTGGTGGTGATACAAACTATGCTAACTCCGTGAAGGGCCGATTCACCATCTCCAGAGAC
AACGCCAAGAACACGGTAGATCTGCAAATGAACAATTTAAAACCTGAGGACACGGCCGTC
TATTACTGTAAGACAATAGTCGAAAAGGACTACTGGGGCCAGGGGAACCAGGTCACCGTC
TCCTCAGGATCTCATCACCATCACCATCACGGATCCACCTCCATTGAAGGTCGTACCCAG
TCTCACTACGGTCAGTGTGGTGGTATTGGTTACTCCGGTCCAACCGTCTGTGCCTCTGGT
ACCACCTGTCAGGTTCTGAACCCTTACTACTCCCAGTGTCTGTAATAA

Figure 12

DNA Sequence of anti-RR6-VHH8-his-CBD

METHOD OF TREATING FABRICS

TECHNICAL FIELD

The present invention generally relates to the use of multi-specific molecules and in particular multi-specific antibodies for treating fabrics, especially garment, with a benefit agent. More in particular, the invention relates to a method of delivering a benefit agent to fabric for exerting a pre-determined activity. In a preferred embodiment, the invention relates to a method of stain bleaching on fabrics which comprises using multi-specific molecules to pre-treat the stained fabric.

BACKGROUND AND PRIOR ART

Multi-functional, in particular multi-specific agents including bi-specific agents are well known in the art. Gluteraldehyde, for example, is widely used as a coupling or crosslinking agent. The development of bi- and multi-functional antibodies has opened a wide scale of new opportunities in various technological fields, in particular in diagnostics but also in the detergent area.

WO-A-98/56885 (Unilever) discloses a bleaching enzyme which is capable of generating a bleaching chemical and having a high binding affinity for stains present on fabrics, as well as an enzymatic bleaching composition comprising said bleaching enzyme, and a process for bleaching stains on fabrics. The binding affinity may be formed by a part of the polypeptide chain of the bleaching enzyme, or the enzyme may comprise an enzyme part which is capable of generating a bleach chemical that is coupled to a reagent having the high binding affinity for stains present on fabrics. In the latter case the reagent may be bispecific, comprising one specificity for stain and one for enzyme. Examples of such bispecific reagents mentioned in the disclosure are antibodies, especially those derived from Camelidae having only a variable region of the heavy chain polypeptide ($V_{HH}$), peptides, peptidomimics, and other organic molecules. The enzyme which is covalently bound to one functional site of the antibody usually is an oxidase, such as glucose oxidase, galactose oxidase and alcohol oxidase, which is capable of forming hydrogen peroxide or another bleaching agent. Thus, if the multi-specific reagent is an antibody, the enzyme forms an enzyme/antibody conjugate which constitutes one ingredient of a detergent composition. During washing, said enzyme/antibody conjugate of the detergent composition is targeted to stains on the clothes by another functional site of the antibody, while the conjugated enzyme catalyzes the formation of a bleaching agent in the proximity of the stain and the stain will be subjected to bleaching.

WO-A-98/00500 (Unilever) discloses detergent compositions wherein a benefit agent is delivered onto fabric by means of peptide or protein deposition aid having a high affinity for fabric. The benefit agent can be a fabric softening agent, perfume, polymeric lubricant, photosensitive agent, latex, resin, dye fixative agent, encapsulated material, antioxidant, insecticide, anti-microbial agent, soil repelling agent, or a soil release agent. The benefit agent is attached or adsorbed to a peptide or protein deposition aid having a high affinity to fabric. Preferably, the deposition aid is a fusion protein containing the cellulose binding domain of a cellulase enzyme. The compositions are said to effectively deposit the benefit agent onto the fabric during the wash cycle.

According to DE-A-196 21 224 (Henkel), the transfer of textile dyes from one garment to another during a washing or rinsing process may be inhibited by adding antibodies against the textile dye to the wash or rinse liquid.

WO-A-98/07820 (P&G) discloses amongst others rinse treatment compositions containing antibodies directed at cellulase and standard softener actives (such as DEQA).

It has now surprisingly been found that a two-step process in which multispecific molecules are bound to pre-treat a fabric, followed by a step in which a benefit agent is bound to said multispecific molecules will result in a more efficient targeting of the benefit agent to the fabric and, accordingly, to a process in which the benefit agent can exert its aimed activity more efficiently.

Based on this principle, the invention can be practiced in various embodiments, which will be explained below.

SUMMARY OF THE INVENTION

According to one aspect of the present invention, there is provided a method of delivering a benefit agent to fabric for exerting a pre-determined activity, which comprises pre-treating said fabric with a multi-specific binding molecule, said binding molecule having a high binding affinity to said fabric through one specificity and is capable of scavenging and binding to said benefit agent through another specificity, followed by contacting said pre-treated fabric with said benefit agent to exert said pre-determined activity to said fabric.

BRIEF DESCRIPTION OF THE DRAWINGS

FIG. 1 shows the nucleotide and amino acid sequence of the HindIII/EcoRI insert of plasmid Fv4715-myc encoding pelB leader-VH4715 and pel leader-VL4715.

FIG. 2 shows the nucleotide and amino acid sequence of the HindIII/EcoRI insert of plasmid scFv4715-myc encoding pelB leader-VH4715-linker-VL4715.

FIG. 3 shows the nucleotide and amino acid sequence of the HindIII/EcoRI insert of plasmid Fv3299-hydro2 encoding pelB leader-VH3299 and pel leader-VL3299 with hydrophil2 tail.

FIG. 4 shows the nucleotide and amino acid sequence of the HindIII/EcoRI insert of plasmid Fv3418 encoding pelB leader-VH3418 and pel leader-VL3418.

FIG. 5 shows the nucleotide and amino acid sequence of the HindIII/EcoRI insert of plasmid pOR4124 encoding pelB leader-VLlys-linker-VHlys.

FIG. 12 shows the DNA sequence of anti-RR6-VHH8-his-CBD.

DETAILED DESCRIPTION OF THE INVENTION

Figure 6:
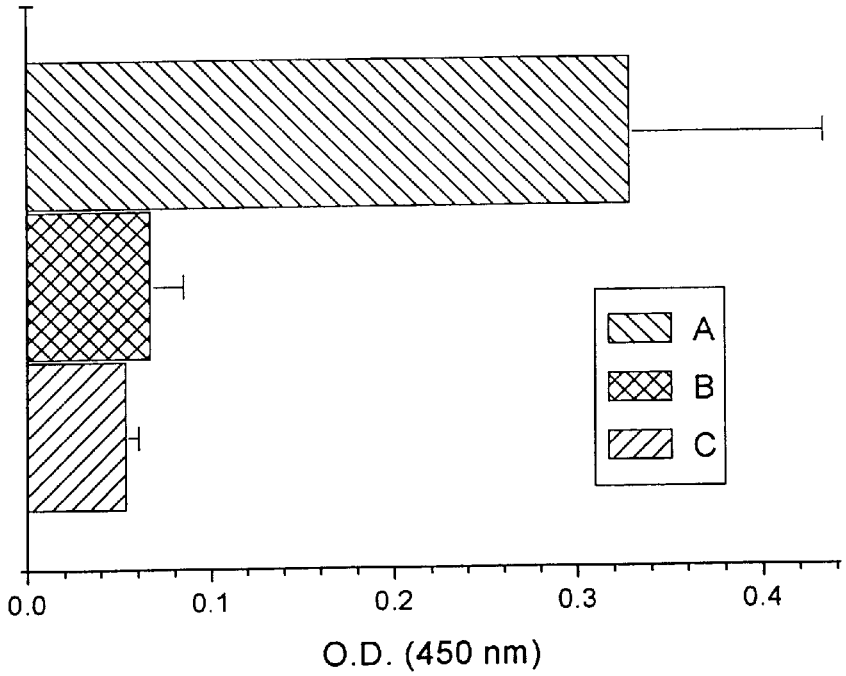
FIG. 6 shows that an activated surface can capture glucose oxidase (A, hCG then Bi-head then glucose oxidase; B, hCG then glucose oxidase; C, no hCG then Bi-head then glucose oxidase)

The invention provides in one aspect the delivery of a multi-specific binding molecule to fabric to which it has a high binding affinity through one specificity, in order to enable a benefit agent which is capable of scavenging and binding to said binding molecule through another specificity to exert a pre-determined activity in close proximity of the pre-treated fabric.

As used herein, the term "multi-specific binding molecule" means a molecule which at least can associate onto fabric and also capture benefit agent. Similarly, the term "bi-specific binding molecule" as used herein indicates a molecule which can associate onto fabric and capture benefit agent.

In a first, pre-treating step the binding molecule is directly delivered to the fabric, for example a garment, preferably at relatively high concentration, thus enabling the binding molecule to bind to the fabric in an efficient way. In a second step, the binding molecule is contacted with the benefit agent, which is usually contained in a dispersion or solution, preferably an aqueous solution, thus enabling the benefit agent to bind to the binding molecule through another specificity of said binding molecule.

The multi-specific binding molecule can be any suitable molecule with at least two functionalities, i.e. having a high binding affinity to the fabric to be treated and being able to bind to a benefit agent, thereby not interfering with the pre-determined activity of the benefit agent and possible other activities aimed. In a preferred embodiment, said binding molecule is an antibody, or an antibody fragment, or a derivative thereof.

The present invention can be advantageously used in, for example, treating stains on fabrics, preferably by bleaching said stains. In a first step, the binding molecule is applied, preferably on the stain. The benefit agent which is then bound to the binding molecule preferably is an enzyme or enzyme part, more preferably an enzyme or enzyme capable of catalysing the formation of a bleaching agent under conditions of use. The enzyme or enzyme part is usually contacted to the binding molecule (and the stains) by soaking the pre-treated fabric into a dispersion or solution comprising the enzyme or enzyme part. The dispersion or solution which usually but not necessarily is an aqueous dispersion or solution also comprises ingredients generating the bleaching agent, or such ingredients are added later. Preferably, the enzyme or enzyme part and said other ingredients generating a bleach are contained in a washing composition, and the step of binding the enzyme (or part thereof) to the binding molecule and generating the bleaching agent is performed during the wash. Alternatively, the benefit agent may be added prior to or after washing, for example in the rinse or prior to ironing.

The targeting of the benefit agent according to the invention which in this typical example is a bleaching enzyme, results in a higher concentration of bleaching agent in the proximity of the stains to be treated, before, during or after the wash. Alternatively, less bleaching enzyme is needed as compared to known non-targeting or less efficient targeting methods of treating stains.

Another typical and preferred example of the use of the present invention is to direct a fragrance (such as a perfume) to fabric to deliver or capture the fragrance so that it is released over time. A further typical use of the present invention is treating a fabric where the colour is faded by directing a benefit agent to the area in order to colour that region. Similarly, a damaged area of a fabric can be (pre-) treated to direct a repair of cellulose fibers which are bound by the antibodies to this area. These agents are for example suitably added to the pre-treated fabric after washing, in the rinse.

Other applications, such as using fabric softening agents, polymeric lubricants, photoprotective agents, latexes, resins, dye fixative agents, encapsulated materials antioxidants, insecticides, anti-microbial agents, soil repelling agents or soil release agents, as well as other agents of choice, and ways and time of adding the agents to the pre-treated fabric are fully within the ordinary skill of a person skilled in the art.

In order to be more fully understood, certain elements of the present invention will be described hereinafter in more detail. Reference is also made to WO-A-98/56885, referred to above, the content of which is incorporated herewith by reference.

1.0 Binding Molecules

In the first step according to the invention a multi-specific binding molecule is delivered to fabric, said binding molecule having a high affinity to said area through one specificity.

The degree of binding of a compound A to another molecule B can be generally expressed by the chemical equilibrium constant $K_d$ resulting from the following reaction:

$$[A]+[B]\Leftrightarrow[A\equiv B]$$

The chemical equilibrium constant $K_d$ is then given by:

$$K_d = \frac{[A]\times[B]}{[A\equiv B]}$$

Whether the binding of a molecule to the fabric is specific or not can be judged from the difference between the binding ($K_d$ value) of the molecule to one type of fabric, versus the binding to another type of fabric material. For applications in laundry, said material will be a fabric such as cotton, polyester, cotton/polyester, or wool. However, it will usually be more convenient to measure $K_d$ values and differences in $K_d$ values on other materials such as a polystyrene microtitre plate or a specialised surface in an analytical biosensor. The difference between the two binding constants should be minimally 10, preferably more than 100, and more preferably, more that 1000. Typically, the molecule should bind to the fabric, or the stained material, with a $K_d$ lower than $10^{-4}$ M, preferably lower than $10^{-6}$M and could be $10^{-10}$M or even less. Higher binding affinities ($K_d$ of less than $10^{-5}$ M) and/or a larger difference between the one type of fabric and another type (or background binding) would increase the deposition of the benefit agent. Also, the weight efficiency of the molecule in the total composition would be increased and smaller amounts of the molecule would be required.

Several classes of binding molecules can be envisaged which deliver the capability of specific binding to fabrics, to which one would like to deliver the benefit agent. In the following we will give a number of examples of such molecules having such capabilities, without pretending to be exhaustive. Reference is also made in this connection to WO 98/56885 (Unilever), the disclosure of which is incorporated herein by reference.

1.1 Antibodies

Antibodies are well known examples of compounds which are capable of binding specifically to compounds against which they were raised. Antibodies can be derived from several sources. From mice, monoclonal antibodies can be obtained which possess very high binding affinities. From such antibodies, Fab, Fv or scFv fragments, can be prepared which have retained their binding properties. Such antibodies or fragments can be produced through recombinant DNA technology by microbial fermentation. Well known production hosts for antibodies and their fragments are yeast, moulds or bacteria.

A class of antibodies of particular interest is formed by the Heavy Chain antibodies as found in Camelidae, like the camel or the llama. The binding domains of these antibodies consist of a single polypeptide fragment, namely the variable region of the heavy chain polypeptide ($V_{HH}$). In contrast, in the classic antibodies (murine, human, etc.), the binding domain consists of two polypeptide chains (the variable regions of the heavy chain ($V_H$) and the light chain ($V_L$)). Procedures to obtain heavy chain immunoglobulins from Camelidae, or (functionalized) fragments thereof, have been described in WO-A-94/04678 (Casterman and Hamers) and WO-A-94/25591 (Unilever and Free University of Brussels).

Alternatively, binding domains can be obtained from the $V_H$ fragments of classical antibodies by a procedure termed "camelization". Hereby the classical $V_H$ fragment is transformed, by substitution of a number of amino acids, into a $V_{HH}$-like fragment, whereby its binding properties are retained. This procedure has been described by Riechmann et al. in a number of publications (J. Mol. Biol. (1996) 259, 957–969; Protein. Eng. (1996) 9, 531–537, Bio/Technology (1995) 13, 475–479). Also $V_{HH}$ fragments can be produced through recombinant DNA technology in a number of microbial hosts (bacterial, yeast, mould), as described in WO-A-94/29457 (Unilever).

Methods for producing fusion proteins that comprise an enzyme and an antibody or that comprise an enzyme and an antibody fragment are already known in the art. One approach is described by Neuberger and Rabbits (EP-A-194 276). A method for producing a fusion protein comprising an enzyme and an antibody fragment that was derived from an antibody originating in Camelidae is described in WO-A-94/25591. A method for producing bispecific antibody fragments is described by Holliger et al. (1993) PNAS 90, 6444–6448.

WO-A-99/23221 (Unilever) discloses multivalent and multispecific antigen binding proteins as well as methods for their production, comprising a polypeptide having in series two or more single domain binding units which are preferably variable domains of a heavy chain derived from an immunoglobulin naturally devoid of light chains, in particular those derived from a Camelid immunoglobulin.

An alternative approach to using fusion proteins is to use chemical cross-linking of residues in one protein for covalent attachment to the second protein using conventional coupling chemistries, for example as described in Bioconjugate Techniques, G. T. Hermanson, ed. Academic Press, Inc. San Diego, Calif., USA. Amino acid residues incorporating sulphydryl groups, such as cysteine, may be covalently attached using a bispecific reagent such as succinimidyl-maleimidophenylbutyrate (SMPB), for example. Alternatively, lysine groups located at the protein surface may be coupled to activated carboxyl groups on the second protein by conventional carbodiimide coupling using 1-ethyl-3-[3-dimethylaminopropyl] carbodiimide (EDC) and N-hydroxy-succinimide (NHS).

A particularly attractive feature of antibody binding behaviour is their reported ability to bind to a "family" of structurally-related molecules. For example, in Gani et al. (J. Steroid Biochem. Molec. Biol. 48, 277–282) an antibody is described that was raised against progesterone but also binds to the structurally-related steroids, pregnanedione, pregnanolone and 6-hydroxy-progesterone. Therefore, using the same approach, antibodies could be isolated that bind to a whole "family" of stain chromophores (such as the polyphenols, porphyrins, or caretenoids as described below). A broad action antibody such as this could be used to treat several different stains when coupled to a bleaching enzyme.

1.2 Fusion Proteins Comprising a Cellulose Binding Domain (CBD)

Another class of suitable and preferred binding molecules for the purpose of the present invention are fusion proteins comprising a cellulose binding domain and a domain having a high binding affinity for another ligand. The cellulose binding domain is part of most cellulase enzymes and can be obtained therefrom. CBDs are also obtainable from xylanase and other hemicellulase degrading enzymes. Preferably, the cellulose binding domain is obtainable from a fungal enzyme origin such as Humicola, Trichoderma, Thermonospora, Phanerochaete, and Aspergillus, or from a bacterial origin such as Bacillus, Clostridium, Streptomyces, Cellulomonas and Pseudomonas. Especially preferred is the cellulose binding domain obtainable from *Trichoderma reesei*.

In the fusion protein, the cellulose binding domain is fused to a second domain having a high binding affinity to another ligand. Preferably, the cellulose binding domain is connected to the domain having a high binding affinity to another ligand by means of a linker consisting of 2–15, preferably 2–5 amino acids.

The second domain having a high binding affinity to another ligand may, for example, be an antibody or an antibody fragment. Especially preferred are heavy chain antibodies such as found in Camelidae.

The CBD antibody fusion binds to the fabric via the CBD region, thereby allowing the antibody domain to bind to corresponding antigens that comprise or form part of the benefit agent.

1.3 Peptides

Peptides usually have lower binding affinities to the substances of interest than antibodies. Nevertheless, the binding properties of carefully selected or designed peptides can be sufficient to provide the desired selectivity to bind a benefit agent or to be used in an aimed process, for example an oxidation process.

A peptide which is capable of binding selectively to a substance which one would like to oxidise, can for instance be obtained from a protein which is known to bind to that specific substance. An example of such a peptide would be a binding region extracted from an antibody raised against that substance. Other examples are proline-rich peptides that are known to bind to the polyphenols in wine.

Alternatively, peptides which bind to such substance can be obtained by the use of peptide combinatorial libraries. Such a library may contain up to $10^{10}$ peptides, from which the peptide with the desired binding properties can be isolated. (R. A. Houghten, Trends in Genetics, Vol 9, no &, 235–239). Several embodiments have been described for this procedure (J. Scott et al., Science (1990) 249, 386–390; Fodor et al., Science (1991) 251, 767–773; K. Lam et al., Nature (1991) 354, 82–84; R. A. Houghten et al., Nature (1991) 354, 84–86).

Suitable peptides can be produced by organic synthesis, using for example the Merrifield procedure (Merrifield (1963) J. Am. Chem. Soc. 85, 2149–2154). Alternatively, the peptides can be produced by recombinant DNA technology in microbial hosts (yeast, moulds, bacteria)(K. N. Faber et al. (1996) Appl. Microbiol. Biotechnol. 45, 72–79).

1.4 Peptidomimics

In order to improve the stability and/or binding properties of a peptide, the molecule can be modified by the incorporation of non-natural amino acids and/or non-natural chemical linkages between the amino acids. Such molecules are called peptidomimics (H. U. Saragovi et al. (1991) Bio/Technology 10, 773–778; S. Chen et al. (1992) Proc. Natl. Acad. Sci. USA 89, 5872–5876). The production of such compounds is restricted to chemical synthesis.

1.5 Other Organic Molecules

The list on proteins and peptides described so far are by no means exhaustive. Other proteins, for example those described in WO-A-00/40968, which is incorporated herein by reference, can also be used.

It can be readily envisaged that other molecular structures which need not be related to proteins, peptides or derivatives thereof, can be found which bind selectively to substances one would like to oxidise with the desired binding properties. For example, certain polymeric RNA molecules which have been shown to bind small synthetic dye molecules (A. Ellington et al. (1990) Nature 346, 818–822). Such binding compounds can be obtained by the combinatorial approach, as described for peptides (L. B. McGown et al. (1995), Analytical Chemistry, 663A-668A).

This approach can also be applied for purely organic compounds which are not polymeric. Combinatorial procedures for synthesis and selection for the desired binding properties have been described for such compounds (Weber et al. (1995) Angew. Chem. Int. Ed. Engl. 34, 2280–2282; G. Lowe (1995), Chemical Society Reviews 24, 309–317; L. A. Thompson et al. (1996) Chem. Rev. 96, 550–600). Once suitable binding compounds have been identified, they can be produced on a larger scale by means of organic synthesis.

2. The Benefit Agent

In general, the benefit agent can be scavenged by the binding molecule and retain at least a substantial part of its desired activity. The benefit agent is chosen to impart a benefit onto the garment. This benefit can be in the form of a bleaching agent (produced by, for example, bleaching enzymes) that can de-colourise stains, fragrances, colour enhancers, fabric regenerators, softening agents, finishing agents/protective agents, and the like. These will be described in more detail below.

2.1 Bleaching Enzymes

Suitable bleaching enzymes which are useful for the purpose of the present invention are capable of generating a bleaching chemical.

The bleaching chemical may be hydrogen peroxide which is preferably enzymatically generated. The enzyme for generating the bleaching chemical or enzymatic hydrogen peroxide-generating system is generally selected from the various enzymatic hydrogen peroxide-generating systems which are known in the art. For example, one may use an amine oxidase and an amine, an amino acid oxidase and an amino acid, cholesterol oxidase and cholesterol, uric acid oxidase and uric acid, or a xanthine oxidase with xanthine. Alternatively, a combination of a $C_1$–$C_4$ alkanol oxidase and a $C_1$–$C_4$ alkanol is used, and especially preferred is the combination of methanol oxidase and ethanol. The methanol oxidase is preferably isolated from a catalase-negative *Hansenula polymorpha* strain. (see for example EP-A-0 244 920 of Unilever). The preferred oxidases are glucose oxidase, galactose oxidase and alcohol oxidase.

A hydrogen peroxide-generating enzyme could be used in combination with activators which generate peracetic acid. Such activators are well-known in the art. Examples include tetraacetylethylenediamine (TAED) and sodium nonanoyloxybenzenesulphonate (SNOBS). These and other related compounds are described in fuller detail by Grime and Clauss in Chemistry & Industry (Oct. 15, 1990) 647–653. Alternatively, a transition metal catalyst could be used in combination with a hydrogen peroxide generating enzyme to increase the bleaching power. Examples of manganese catalysts are described by Hage et al. (1994) Nature 369, 637–639.

Alternatively, the bleaching chemical is hypohalite and the enzyme is then a haloperoxidase. Preferred haloperoxidases are chloroperoxidases and the corresponding bleaching chemical is hypochlorite. Especially preferred chloroperoxidases are vanadium chloroperoxidases, for example from *Curvularia inaequalis*.

Alternatively, peroxidases or laccases may be used. The bleaching molecule may be derived from an enhancer molecule that has reacted with the enzyme. Examples of laccase/enhancer systems are given in WO-A-95/01426. Examples of peroxidase/enhancer systems are given in WO-A-97/11217.

Suitable examples of bleaches include also photobleaches. Examples of photobleaches are given in EP-A-379 312 (British Petroleum), which discloses a water-insoluble photobleach derived from anionically substituted porphine, and in EP-A-035 470 (Ciba Geigy), which discloses a textile treatment composition comprising a photobleaching component.

2.2 Fragrances

The benefit agent can be a fragrance (perfume), thus through the application of the invention it is able to impart onto the fabric a fragrance that will remain associated with the fabric for a longer period of time than conventional methods. Fragrances can be captured by the binding molecule directly, more preferable is the capture of "packages" or vesicles containing fragrances. The fragrances or perfumes may be encapsulated, e.g. in latex microcapsules. Of special interest are plant oil bodies, for instance those which can be isolated from rape seeds (Tzen et al. (J. Biol. Chem. 267, 15626–15634).

2.3 Colour Enhancers

The benefit agent can be an agent used to replenish colour on garments. These can be dye molecules or, more preferable, dye molecules incorporated into "packages" or vesicles enabling larger deposits of colour.

2.4 Fabric Regenerating Agents

The benefit agent can be an agent able to regenerate damaged fabric. For example, enzymes able to synthesise cellulose fibres could be used to build and repair damaged fibres on the garment.

2.5 Others

A host of other agents could be envisaged to impart a benefit to fabric. These will be apparent to those skilled in the art and will depend on the benefit being captured at the fabric surface. Examples of softening agents are clays, cationic surfactants or silicon compounds. Examples of finishing agents/protective agents are polymeric lubricants, soil repelling agents, soil release agents, photo-protective agents (sunscreens), anti-static agents, dye-fixing agents, anti-bacterial agents and anti-fungal agents.

3.1 The Fabrics

For laundry detergent applications, several classes of natural or man-made fabrics can be envisaged, in particular cotton. Such macromolecular compounds have the advantage that they can have a more immunogenic nature, i.e. that it is easier to raise antibodies against them. Furthermore, they are more accessible at the surface of the fabric than for instance coloured substances in stains, which generally have a low molecular weight.

An important embodiment of the invention is to use a binding molecule (as described above) that binds to several different types of fabrics. This would have the advantage of enabling a single benefit agent to be deposited to several different types of fabric.

The invention can be applied in otherwise conventional detergent compositions for washing fabrics as well in rinse compositions. The invention will now be further illustrated by the following, non-limiting examples.

EXAMPLE 1

Scavenging Glucose Oxidase from Solution Using an Activated Surface 1.1 Preparation of a Double-Headed Antibody Fragment 1.1.1 Materials for Construction of Expression Vectors 1.1.1.1 Plasmids Five different (pUC derived) plasmids were used as starting material (for nucleotide sequences, see FIG. 1).

a) pUC.Fv4715-myc b) pUC.scFv4715-myc c) pUC.Fv3299-H2t d) pUC.Fv3418 e) pUR.4124

All cloning steps were performed in *E. coli* JM109 (endA1, recA1, gyrA96, thi, hsdR17($r_K^-$, $m_K^+$), relA1, supE44, (lac-proAB), [F', traD36, proAB, lacI$^q$Z□M15].

*E. coli* cultures were grown in 2xTY medium (where indicated supplemented with 2% glucose and/or 100 μg/ml ampicillin), unless otherwise indicated. Transformations were plated out on SOBAG plates.

| 1.1.1.2 Buffers and media | |
|---|---|
| PBS | 0.24 g $NaH_2PO_4.H_2O$<br>0.49 g $Na_2HPO_4$ anhydrous<br>4.25 g NaCl<br>make up to 1 liter in $H_2O$ (pH = 7.1) |
| PBS-T | PBS + 0.15% Tween |
| 2xTY Medium | 17 g Bacto-tryptone<br>10 g Bacto-yeast Extract<br>5 g NaCl<br>Make up to 1 liter with distilled water and autoclave. |
| 2xTY/Amp/Glucose | 2xTY + 100 μg/mL Ampicillin + 1% Glucose |
| M9P + Yeast | 12 g $Na_2HPO_4$, 6 g $KH_2PO_4$, 0.5 g NaCl, 5 g $NH_4Cl$, 0.06 g L-Proline, 20 g Glycerol, 2 mL Haemin. Make up to 1 liter with distilled water and autoclave. Before use add 12.5 mL 10% Yeast extract, 2.5 mL 0.01% Thiamin, 500 μL 1M $MgCl_2$, 25 μL 1M $CaCl_2$. |
| SOBAG agar | 20 g Bacto-tryptone<br>5 g yeast extract<br>15 g agar<br>0.5 g NaCl<br>Make up to 1 liter with distilled water and autoclave.<br>Allow to cool and add: 10 mL 1M $MgCl_2$, 27.8 mL 2M Glucose, 100 μg/ml ampicillin. |

1.1.1.3 Oligonucleotides and PCR

The oligonucleotide primers used in the PCR reactions were synthesized on an Applied Biosystems 381A DNA Synthesiser by the phosphoramidite method. The primary structures of the oligonucleotide primers used in the construction of the bispecific 'pGOSA' constructs are shown in Table 1 below.

| Nucleotide sequence of the oligonucleotides used to produce the constructs described | | |
|---|---|---|
| DBL.1 | 5' | CAC CAT CTC CAG AGA CAA TGG CAA G |
| DBL.2 | 5' | GAG GGC GAG CTC GGC CGA ACC GGC C[1]GA TGC GCC ACC GCC AGA GCC |
| DBL.3 | 5' | CAG GAT CCG GCC GGT TCG GCC[1] CAG GTG CAG GTG CAA GAG TGA GGA |
| DBL.4 | 5' | CTA CAT GAA TTC[2] GCT AGC[3] TTA TTA TGA GGA GAG GGT GAG GGT GGT CCC TTG GC |
| DBL.5 | 5' | TAA TAA GCT AGC[3] GGA GCT GCA TGC AAA TTC TAT TTC |
| DBL.6 | 5' | ACC AAG CTC GAG[4] ATC AAA CGG GG |
| DEL.7 | 5' | AAT GTC GAA TTC[2] GTC GAC[5] TCC GCC ACC GCC AGA GCC |
| DBL.8 | 5' | ATT GGA GTC GAC[5] ATC GAA CTC ACT GAG TCT CCA TTC<br>TCC |
| DBL.9 | 5' | TGA AGT GAA TTC[2] GCG GCC GC[6]T TAT TAG CGT TTG ATT TCG AGC TTG GTC CC |
| DBL.10 | 5' | CGA ATT CGG TCA CC[8]G TCT CCT GAG AGG TCC AGT TGC<br>AAC AG |
| DBL.11 | 5' | CGA ATT CTC GAG[4] ATC AAA CGG GAG ATC GAA CTC ACT CAG TCT CC |

-continued

| Nucleotide sequence of the oligonucleotides used to produce the constructs described | | |
|---|---|---|
| DBL.12 | 5' | CGA ATT CGG TCA CC[8]G TCT CCT CAC AGG TGC AGT TGC AGG AG |
| PCR.51 | 5' | AGG T(C/G) (A/C) A(C/A)C TGC AG[7] (GIG) AGT C(A/T) G G |
| PCR.89 | 5' | TGA GGA GAG GGT GAC C[8]GT GGT CCC TTG GCC CC |
| PCR.90 | 5' | GAG ATT GAG CTC[9] ACC GAG TCT CCA |
| PCR.116 | 5' | GTT AGA TCT CGA G[4]CT TGG TCC C |

Restriction sites encoded by these primers are underlined.

[1]= SfiI, [2]= EcoRI, [3]= NheT, [4]= XhoI, [5]= SalI, [6]= NotI, [7]= PstI, [8]= BstEII, [9]= SacI

The reaction mixture used for amplification of DNA fragments was: 10 mM Tris-HCl, pH8.3/2.5 mM $MgCl_2$/50 mM KCl/0.01% gelatin (w/v)/0.1% Triton X-100/400 mM of each dNTP/5.0 units of DNA polymerase/500 ng of each primer (for 100 μl reactions) plus 100 ng of template DNA. Reaction conditions were: 94° C. for 4 minutes, followed by 33 cycles of 1 minute at 94° C., 1 minute at 55° C. and 1 minute at 72° C.

1.1.2 Plasmid DNA\Vector\Insert Preparation and Ligation\Transformation

Plasmid DNA was prepared using the 'Qiagen P-100 Midi-DNA Preparation' system. Vectors and inserts were prepared by digestion of 10 μg (for vector preparation) or 20 μg (for insert preparation) with the specified restriction endonucleases under appropriate conditions (buffers and temperatures as specified by suppliers). Modification of the DNA ends with Klenow DNA polymerase and dephosphorylation with Calf Intestine Phosphorylase were performed according to the manufacturers instructions. Vector DNA and inserts were separated by agarose gel electrophoresis and purified with DEAE-membranes NA45 (Schleicher & Schnell) as described by Maniatis et al. Ligations were performed in 20 ul volumes containing:

30 mM Tris-HCl pH7.8

10 mM $MgCl_2$ 10 mM DTT 1 mM ATP

300–400 ng vector DNA

100–200 ng insert DNA

1 Weiss unit $T_4$ DNA ligase.

After ligation for 2–4 h at room temperature, $CaCl_2$ competent *E. coli* JM109 were transformed using 7.5 μl ligation reaction. The transformation mixtures were plated onto SOBAG plates and grown overnight at 37° C. Correct clones were identified by restriction analysis and verified by automated dideoxy sequencing (Applied Biosystems).

1.1.3 Restriction Digestion of PCR Products

Following amplification each reaction was checked for the presence of a band of the appropriate size by agarose gel electrophoresis. One or two 100 μl PCR reaction mixtures of each of the PCR reactions PCR.I—PCR.X, together containing approximately 2–4 μg DNA product were subjected to phenol-chloroform extraction, chloroform extraction and ethanol precipitation. The DNA pellets were washed twice with 70% ethanol and allowed to dry. Next, the PCR products were digested overnight (18 h) in the presence of excess restriction enzyme in the following mixes at the specified temperatures and volumes.

| | |
|---|---|
| PCR.I: | 50 mM Tris-HCl pH 8.0, 10 mM $MgCl_2$, 50 mM NaCl, 4 mM spermidine, 0.4 μg/ml BSA, 4 μl (= 40 U) SacI, 4 μl (= 40 U) BstEII, in 100 μl total volume at 37° C. |
| PCR.II: | 10 mM Tris-Acetate pH 7.5, 10 mM $MgAc_2$, 50 mM KAc (1x "One-Phor-All" buffer {Pharmacia}), 4 μl (= 48 U) SfiI, in 50 μl total volume at 50° C. under mineral oil. |
| PCR.III: | 10 mM Tris-Acetate pH 7.5, 10 mM $MgAc_2$, 50 mM KAc (1x "One-Phor-All" buffer {Pharmacia}), 4 μl (= 40 U) NheI, 4 μl (= 40 U) SacI, in 100 μl total volume at 37° C. |
| PCR.IV: | 20 mM Tris-Acetate pH 7.5, 20 mM $MgAc_2$, 100 mM KAc (2x "One-Phor-All" buffer {Pharmacia}), 4 μl (= 40 U) XhoI, 4 μl (= 40 U) EcoRI, in 100 μl total volume at 37° C. |
| PCR.V: | 20 mM Tris-Acetate pH 7.5, 20 mM $MgAc_2$, 100 mM KAc (2x "One-Phor-All" buffer {Pharmacia}), 4 μl (= 40 U) SalI, 4 μl (= 40 U) EcoRI, in 100 μl total volume at 37° C. |
| PCR.VI: | 10 mM Tris-Acetate pH 7.5, 10 mM $MgAc_2$, 50 mM KAc (1x "One-Phor-All" buffer {Pharmacia}), 4 μl (= 48 U) SfiI, in 50 μl total volume at 50° C. under mineral oil. |
| PCR.VII: | 50 mM Tris-HCl, pH 8.0, 10 mM $MgCl_2$, 50 mM NaCl, 4 mM spermidine, 0.4 μg/ml BSA, 4 μl (= 40 U) NheI, 4 μl (= 40 U) BstEII, in 100 μl total volume at 37° C. |
| PCR.VIII: | 20 mM Tris-Acetate pH 7.5, 20 mM $MgAc_2$, 100 mM KAc (2x "One-Phor-All" buffer {Pharmnacia}), 4 μl (= 40 U) EcoRI, in 50 μl total volume at 37° C. |
| PCR.IX: | 25 mM Tris-Acetate, pH7.8, 100 mM KAc, 10 mM MgAc, 1 mM DTT (1x "Multi-Core" buffer {Promega}, 4 mM spermidine, 0.4 μg/ml BSA, 4 μl (= 40 U) NheI, 4 μl (= 40 U) EstEII, in 100 μl total volume at 37° C. |
| PCR.X: | 50 mM Tris-HCl, pH 8.0, 10 mM $MgCl_2$, 50 mM NaCl, 4 mM spermidine, 0.4 μg/ml BSA, 4 μl (= 40 U) PstI, 4 μl (= 40 U) EcoRI, in 100 μl total volume at 37° C. |

After overnight digestion, PCR.II-SfiI was digested with EcoRI (overnight at 37° C.) by the addition of 16 μl $H_2O$, 30 μl 10× "One-Phor-All" buffer (Pharmacia)(100 mM Tris-Acetate pH 7.5, 100 mM $MgAc_2$, 500 mM KAc) and 4 μl (=40 U) EcoRI. After overnight digestion, PCR.VI-SfiI was digested with NheI (overnight at 37° C.) by the addition of 41 μl $H_2O$, 5 μl 10× "One-Phor-All" buffer (Pharmacia)(100 mM Tris-Acetate pH 7.5, 100 mM $MgAc_2$, 500 mM KAc) and 4 μl (=40 U) NheI. After overnight digestion, PCR.VIII- EcoRI was digested with XhoI (overnight at 37° C.) by the addition of 46 μl $H_2O$ and 4 μl (=40 U) XhoI.

The digested PCR fragments PCR.I-SacI/BstEII, PCR.II-SfiI/EcoRI, PCR.III-NheI/SacI, PCR.IV-XhoI/EcoRI, PCR.V-SalI/EcoRI, PCR.VI-SfiI/NheI, PCR.VII-BstEII/NheI and PCR.VIII-XhoI/EcoRI were purified on an 1.2% agarose gel using DEAE-membranes NA45 (Schleicher & Schnell) as described by Maniatis et al. The purified fragments were dissolved in $H_2O$ at a concentration of 100–150 ng/μl.

1.1.4 Construction of the pGOSA Double-Head Expression Vectors

The expression vectors used were derivatives of pUC.19 containing a HindIII-EcoRI fragment that in the case of the scFvs contains one pelB signal sequence fused to the 5' end of the heavy chain V-domain that is directly linked to the corresponding light chain V-domain of the antibody through a connecting sequence that codes for a flexible peptide $(Gly_4Ser)_3$ thus generating a single-chain molecule. In the dual-chain Fv expression vector both the heavy chain and the light chain V-domains of the antibody are preceded by a ribosome binding site and a pelB signal sequence in an artificial dicistronic operon under the control of a single inducible promoter. Expression of these constructs is driven by the inducible lacZ promoter. The nucleotide sequence of the HindIII-EcoRI inserts of the Fv.3418, Fv.4715-myc, scFv.4715-myc and pUR.4124 constructs used for the generation of the bispecific antibody fragments are listed in FIG. 1.

The construction of pGOSA.E involved several cloning steps that produced 4 intermediate constructs PGOSA.A to pGOSA.D. The final expression vector pGOSA.E and the oligonucleotides in Table.1 have been designed to allow most specificities to be cloned into the final pGOSA.E construct. The upstream VH domain can be replaced by any PstI-BstEII VH gene fragment obtained with oligonucleotides PCR.51 and PCR.89. The oligonucleotides DBL.3 and DBL.4 were designed to introduce SfiI and NheI restriction sites in the VH gene fragments thus allowing cloning of those VH gene fragments into the SfiI-NheI sites as the downstream VH domain. All VL gene fragments obtained with oligonucleotides PCR.116 and PCR.90 can be cloned into the position of the 3418 VL gene fragment as a SacI-XhoI fragment. A complication here however is the presence of an internal SacI site in the 3418 VH gene fragment. Oligonucleotides DBL.8 and DBL.9 are designed to allow cloning of VL gene fragments into the position of the 4715 VL gene fragment as a SalI-NotI fragment. The pGOSA.E derivatives pGOSA.V, pGOSA.S and pGOSA.T with only one or no linker sequences contain some abberant restriction sites at the new joining points. The $VH_A$–$VH_B$ construct without a linker lacks the 5'$VH_B$ SfiI site. The $VH_B$ fragment is cloned into these constructs as a BstEII/NheI fragment using oligonucleotides DBL.10 or DBL.11 and DBL.4. The $VL_B$–$VL_A$ construct without a linker lacks the 5'$VL_A$ SalI site. The $VL_A$ fragment is cloned into these constructs as a XhoI/EcoRI fragment using oligonucleotides DBL.11 and DBL.9.

pGOSA.A: This construct was derived from the scFv.4715-myc construct. A SfiI restriction site was introduced between the $(Gly_4Ser)_3$ linker and the gene fragment encoding the VL of the scFv.4715-myc construct. This was achieved by replacing the BstEII-SacI fragment of this construct by the fragment PCR-I BstEII/SacI that contains a SfiI site between the $(Gly_4Ser)_3$ linker and the 4715 VL. The introduction of the SfiI site also introduced 4 additional amino acids (Ala-Gly-Ser-Ala) between the $(Gly_4Ser)_3$ linker and the 4715 VL gene fragment. The oligonucleotides used to produce PCR-I (DBL.1 and DBL.2) were designed to match the sequence of the framework-3 region of the 4715 VH and to prime at the junction of the $(Gly_4Ser)_3$ linker and the gene encoding the 4715 VL respectively (Table 1).

pGOSA.B: This construct was derived from the Fv.3418 construct. The XhoI-EcoRI fragment of Fv.3418 encoding the 3' end of framework-4 of the VL including the stop codon was removed and replaced by the fragment PCR-IV XhoI/EcoRI. The oligonucleotides used to produce PCR-IV (DBL.6 and DBL.7) were designed to match the sequence at the junction of the VL and the $(Gly_4Ser)_3$ linker perfectly (DBL.6), and to be able to prime at the junction of the $(Gly_4Ser)_3$ linker and the VH in pUR.4124 (DBL.7)(Table 1). DBL.7 removed the PstI site in the VH (silent mutation) and introduced a SalI restiction site at the junction of the $(Gly_4Ser)_3$ linker and the VH, thereby replacing the last Ser of the linker by a Val residue.

PGOSA.C: This construct contained the 4715 VH linked by the $(Gly_4Ser)_3$Ala-Gly-Ser-Ala linker to the 3418 VH. This construct was obtained by replacing the SfiI-EcoRI fragment from pGOSA.A encoding the 4715 VL by the fragment PCR-II SfiI/EcoRI encoding the 3418 VH. The oligonucleotides used to produce PCR-II (DBL.3 and DBL.4)(Table 1) hybridize in the framework-1 and framework-4 region of the gene encoding the 3418 VH respectively. DBL.3 was designed to remove the PstI restriction site (silent mutation) and to introduce a SfiI restriction site upstream of the VH gene. DBL.4 destroys the BstEII restriction site in the framework-4 region and introduces a NheI restriction site downstream of the stopcodons.

pGOSA.D: This construct contained a dicistronic operon consisting of the 3418 VH and the 3418 VL linked by the $(Gly_4Ser)_2Gly_4$Val linker to the 4715 VL. This construct was obtained by digesting the pGOSA.A construct with SalI-EcoRI and inserting the fragment PCR-V SalI/EcoRI containing the 4715 VL. The oligonucleotides used to obtain PCR-V (DBL.8 and DBL.9)(Table 1) were designed to match the nucleotide sequence of the framework-1 and framework-4 regions of the 4715 VL gene respectively. DBL.8 removed the SacI site from the framework-1 region (silent mutation) and introduced a SalI restriction site upstream of the VL chain gene. DBL.9 destroyed the XhoI restriction site in the framework 4 region of the VL (silent mutation) and introduced a NotI and a EcoRI restriction site downstream of the stop codons.

pGOSA.E: This construct contained a dicistronic operon consisting of the the 4715 VH linked by the $(Gly_4Ser)_3$Ala-Gly-Ser-Ala linker to the 3418 VH plus the 3418 VL linked by the $(Gly_4Ser)_2Gly_4$Val linker to the 4715 VL. Both translational units are preceded by a ribosome binding site and a pelB leader sequence. This construct was obtained by a three-point ligation by mixing the pGOSA.D vector from which the PstI-SacI insert was removed, with the PstI-NheI pGOSA.C insert and the fragment PCR-III NheI/SacI. The PstI-SacI pGOSA.D vector contains the 5'end of the framework-1 region of the 3418 VH upto the PstI restriction site and the 3418 VL linked by the $(Gly_4Ser)_2Gly_4$Val linker to the 4715 VL starting from the SacI restriction site in the 3418 VL. The PstI-NheI pGOSA.C insert contains the 4715 VH linked by the $(Gly_4Ser)_3$Ala-Gly-Ser-Ala linker to the 3418 VH, starting from the PstI restriction site in the framework-1 region in the 4715 VH. The NheI-SacI PCR-III fragment provides the ribosome binding site and the pelB leader sequence for the 3418 VL-$(Gly_4Ser)_2Gly_4$Val-4715 VL construct. The oligonucleotides DBL.5 and PCR.116 (Table 1) used to generate PCR-III were designed to match the sequence upstream of the ribosome binding site of the 4715 VL in Fv.4715 and to introduce a NheI restriction site (DBL.5), and to match the framework-4 region of the 3418 VL (PCR.116).

pGOSA.G: This construct was an intermediate for the synthesis of pGOSA.J. It is derived from pGOSA.E from which the VH4715 PstI/BstEII fragment has been excised and replaced by the VH3418 PstI/BstEII fragment (excised from Fv.3418). The resulting plasmid pGOSA.G contains two copies of the 3418 Heavy chain V-domain linked by the $(Gly_4Ser)_3$Ala-Gly-Ser-Ala linker, plus the 4715 VL linked by the $(Gly_4Ser)_2Gly_4$Val linker to the framework 4 region of the 3418 VL.

pGOSA.J: This construct contained a dicistronic operon consisting of the 3418 VH linked by the $(Gly_4Ser)_3$Ala-Gly-Ser-Ala linker to the 4715 VH plus the 3418 VL linked by the $(Gly_4Ser)_2Gly_4$Val linker to the 4715 VL. Both transcriptional units are preceded by a ribosome binding site and a pelB leader sequence. This construct was obtained by inserting the fragment PCR-VI SfiI/NheI which contains the VH4715, into the vector pGOSA.G from which the SfiI/NheI VH3418 which was removed.

pGOSA.L: This construct was derived from pGOSA.E from which the HindIII/NheI fragment containing the 4715 VH-$(Gly_4Ser)_3$Ala-Gly-Ser-Ala-3418 VH encoding gene was removed. The DNA ends of the vector were made blunt-end using Klenow DNA polymerase and ligated. The resulting plasmid pGOSA.L contains the 3418 VL domain linked by the $(Gly_4Ser)_2Gly_4$Val linker to the 5' end of the framework 1 region of the 4715 VL domain.

pGOSA.V: This construct was derived from pGOSA.E from which the VH3418-$(Gly_4Ser)_3$Ala-Gly-Ser-Ala linker BstEII/NheI fragment has been excised and replaced by the fragment PCR-VII BstEII/NheI which contains the 3418 VH. The resulting plasmid pGOSA.V contains the 3418 Heavy chain V-domain linked directly to the framework 4 region of the 4715 VH, plus the 4715 VL linked by the $(Gly_4Ser)_2Gly_4$Val linker to the framework 4 region of the 3418 VL.

pGOSA.S: This construct was derived from pGOSA.E from which the $(Gly_4Ser)_2Gly_4$Val-VL4715 XhoI/EcoRI fragment has been excised and replaced by the fragment PCR-VIII XhoI/EcoRI which contains the 4715 VL. The resulting plasmid pGOSA.S contains the 4715 VH linked by the $(Gly_4Ser)_3$Ala-Gly-Ser-Ala linker to the 3418 VH plus the 3418 VL linked directly to the 5' end of the framework 1 region of the 4715 VL.

pGOSA.T: This construct contained a dicistronic operon consisting of the 3418 Heavy chain V-domain linked directly to the framework 4 region of the 4715 VH plus the 3418 VL linked directly to the 5' end of the framework 1 region of the 4715 VL. Both transcriptional units are preceded by a ribosome binding site and a pelB leader sequence. This construct was obtained by inserting the NheI/EcoRI fragment of pGOSA.S which contains the 3418 VL linked directly to the 5'end of the framework 1 region of the 4715 VL, into the vector pGOSA.V from which the NheI/EcoRI fragment containing the 3418 VL linked by the $(Gly_4Ser)_2Gly_4$Val linker to the 4715 VL was removed.

pGOSA.X: This construct was derived from pGOSA.T from which the NheI/EcoRI fragment containing the 3418 VL-4715 VL encoding gene was removed. The DNA ends of the vector were made blunt-end (Klenow) and ligated. The resulting plasmid pGOSA.X: contains the 4715 VH domain linked directly to 5'end of the framework 1 region of the 3418 VH domain.

pGOSA.Y: This construct was derived from pGOSA.T from which the HindIII/NheI fragment containing the 4715 VH-3418 VH encoding gene was removed. The DNA ends of the vector were made blunt-end using Klenow DNA polymerase and ligated. The resulting plasmid pGOSA.Y contains the 3418 VL domain linked directly to 5' end of the framework 1 region of the 4715 VL domain.

pGOSA.Z: This construct was derived from pGOSA.G from which the VH3418-$(Gly_4Ser)_3$Ala-Gly-Ser-Ala linker BstEII/NheI fragment has been excised and replaced by the fragment PCR-IX BstEII/NheI which contains the 4715 VH. The resulting plasmid pGOSA.Z contains the 3418 Heavy chain V-domain linked directly to the framework 1 region of the 4715 VH, plus the 4715 VL linked by the $(Gly_4Ser)_2Gly_4$Val linker to the framework 4 region of the 3418 VL.

PGOSA.AA: This construct contained a dicistronic operon consisting of the 3418 Heavy chain V-domain linked directly to the 5' end of the framework 1 region of the 4715 VH plus the 3418 VL linked directly to the 5' end of the framework 1 region of the 4715 VL. Both transcriptional units are preceded by a ribosome binding site and a pelB leader sequence. This construct was obtained by inserting the NheI/EcoRI fragment of pGOSA.T which contains the 3418 VL linked directly to the 5' end of the framework 1 region of the 4715 VL, into the vector pGOSA.Z from which the NheI/EcoRI fragment containing the 3418 VL linked by the $(Gly_4Ser)_2Gly_4$Val linker to the 4715 VL was removed.

pGOSA.AB: This construct was derived from pGOSA.J by a three point ligation reaction. The SacI/EcoRI insert, containing part of the 3418 VH and the full $(Gly_4Ser)_3$Ala-Gly-Ser-Ala linker-4715 VH and the 3418 VL-$(Gly_4Ser)_2Gly_4$Val-4715 VL encoding sequences was removed and replaced by the SacI/SacI pGOSA.J fragment containing part of the 3418 VH and the full $(Gly_4Ser)_3$Ala-Gly-Ser-Ala linker-4715 VH and the SacI/EcoRI pGOSA.T fragment containing the 3418 VL linked directly to the framework 1 region of the 4715 VL. The resulting plasmid contains the 3418 VH linked by the $(Gly_4Ser)_3$Ala-Gly-Ser-Ala linker to the 5' end of the framework 1 region of the 4715 VH plus the 3418 VL linked directly to the 5' end of the framework 1 region of the 4715 VL.

PGOSA.AC: This construct was derived from pGOSA.Z from which the NheI/EcoRI fragment containing the 3418 VL-$(Gly_4Ser)_2Gly_4$Val-4715 VL encoding gene was removed. The DNA ends of the vector were made blunt-end using Klenow DNA polymerase and ligated. The resulting plasmid pGOSA.AC contains the 3418 VH domain linked directly to 5' end of the framework 1 region of the 4715 VH domain.

pGOSA.AD: This construct was obtained by inserting the PstI/EcoRI PCR.X fragment containing the 3418 VH-$(Gly_4Ser)_3$Ala-Gly-Ser-Ala-4715 VH encoding gene fragment into the Fv.4715-myc vector from which the PstI/EcoRI Fv.4715-myc insert was removed.

1.1.5 Construction of the pAlphagox Double-Head Expression Vectors

The expression vectors used were derivatives of pGOSA.E,S,T and V in which the heavy chain and the light chain V-domains of the antibody were preceded by a ribosome binding site and a pelB signal sequence in an artificial dicistronic operon under the control of a single inducible promoter. The inducible lacZ promoter drove expression of these constructs.

pAlphagox.A: This construct was derived from pGOSA.E from which the PstI/BstEII 4715 VH gene fragment was removed and replaced by the PstI/BstEII 3299 VH gene fragment from pUC.Fv3299H2t.

pAlphagox.B: This construct was derived from pGOSA.V from which the PstI/BstEII 4715 VH gene fragment was removed and replaced by the PstI/BstEII 3299 VH gene fragment from pUC.Fv3299H2t.

pAlphagox.C: This construct was derived from pAlphagox.A from which the SalI/EcoRI 4715 VL gene fragment was removed and replaced by the SalI/EcoRI 3299 VL equivalent of PCR.V pAlphagox.D: This construct was derived from pAlphagox.B from which the SalI/EcoRI 4715 VL gene fragment was removed and replaced by the SalI/EcoRI 3299 VL equivalent of PCR.V pAlphagox.E: This construct was derived from pAlphagox.A from which the XhoI/EcoRI 4715 VL gene fragment was removed and replaced by the XhoI/EcoRI 3299 VL equivalent of PCR.VII pAlphagox.F: This construct was derived from pAlphagox.B from which the XhoI/EcoRI 4715 VL gene fragment was removed and replaced by the XhoI/EcoRI 3299 VL equivalent of PCR.VII 1.1.6 Expression of GOSA and ALPHAGOX Constructs in *E. coli*

Although the following protocol describes the production of 5OOmL supernatant and 2×100 mL periplasmic extract this protocol can easily be scaled up.

1) Inoculate 2.5 mL 2×TY/Amp with an individual well-isolated colony from a plate with freshly transformed JM109. Incubate o/n at 37° C. with shaking at 200 rpm.
2) Plate out 100 μL aliquots of $10^{-3}$, $10^{-4}$, $10^{-5}$, and $10^{-6}$ dilutions of the o/n culture on 2TY/Amp plates.
3) After o/n incubation at 37° C. two types of colonies are usually visible; small 'Creamy' and large 'Grey' types.
4) Set up starter cultures of both 'creamy' and 'grey' colony types in 10 mL BHI/Amp o/n 37° C. (no shaking).
5) 5 mL of the o/n starter cultures is used to inoculate 500 mL M9P+Yeast medium.
6) The culture is grown at 25° C. with shaking at 150–200 rpm (in baffled flasks) until $OD_{600}$=0.6–1.0.
7) IPTG is added to a final concentration of 1 mM.
8) Incubate the culture overnight at 25° C. with shaking at 150–200 rpm.
9) Centrifuge the overnight culture and test the supernatant for the presence of antibody fragment.
10) The product present in the periplasmic space can be extracted by two consecutive osmotic shock lysis.

1.2 Activating a Surface with a Double-Headed Antibody Fragment

A 50 μg/ml solution of human chorionic gonadotrophin (hCG) was made up in phosphate buffered saline (PBS) and 100 μl was added per well of a Greiner HB microtitre plate. Following a 60 minute incubation at room temperature with constant agitation the wells were washed three times with 200 μl PBS containing 0.15% (v/v) Tween 20 (PBST). The wells were then blocked by a 60 minute incubation with 1% (w/v) Marvel at room temperature. The surface was activated by a 30 minute incubation with 0.25 μg/well of double head (alphagox) in a PBS solution pH adjusted to 8.0. Following activation of the surface each well was washed three times with 200 μl PBST.

1.3 Scavenging Glucose Oxidase from a Solution

A solution of glucose oxidase (100 μl of a 60 μg/ml solution made up in PBS) was incubated for 60 minutes at room temperature with gentle agitation. During this time the glucose oxidase was captured at the activated surface. Following the capture of glucose oxidase at the activated surface each well was washed three times with 200 μl PBST. The presence of captured glucose oxidase was revealed by incubation with a substrate solution comprising; 50 mM glucose, 5 μl of peroxidase (Novo) at 21.8 mg/ml, 200 μl TMB made up to 20 ml with PBS at pH 8.0. After 10 minutes 50 μl of HCl (1 M) was added and the optical density of the ELISA plate was read at 450 nm. FIG. 6 shows that an activated surface can capture glucose oxidase (A, hCG then Bi-head then glucose oxidase; B, hCG then glucose oxidase; C, no hCG then Bi-head then glucose oxidase).

EXAMPLE 2

Scavenging Glucose Oxidase from Solution Onto Red Wine Activated Plastic 2.1 Preparation of a Bi-Headed Antibody Fragment A bi-headed antibody fragment (12.49) with dual specificity for red wine and glucose oxidase was constructed, produced and purified as follows:

2.1.1 Preparation of a Red Wine Specific Heavy Chain Immunoglobulin Fragment from Llama 2.1.1.1 Antigen Preparation Cote du Rhone red wine (Co-op) was filtered through a 0.2μ membrane and then used either neat or diluted in PBS as appropriate.

2.1.1.2 Immunisation Schedule

A llama, kept at the Dutch Institute for Animal Science and Health (ID-DLO, Lelystad), was immunised first with BSA-red wine linked by periodate chemistry and thereafter boosted one month later and then a further two months later with red wine conjugated to PLP. Serum was removed 14 days after each boost for analysis.

2.1.1.3 Polyclonal Sera Analysis

Sera were analysed by ELISA against red wine as follows:

1. A Greiner HB microtitre plate was sensitised with red wine at 37° C. and then washed in PBSTA.
2. The plate was blocked by pre-incubating with 200 μl/well 1% (w/v) ovalbumin in PBSTA for 1 hour at room temperature.
3. Blocking buffer was removed and 100 μl/well llama immunised sera or prebleed, beginning with a $10^{-2}$ dilution in PBSA, added. Incubations were for 1 hour at room temperature.
4. Unbound antibody fragment was removed by washing 3× using a plate washer in PBSTA.
5. 100 μl/well of rabbit anti-llama IgG was added at 10 μg/ml in PBSTA. Incubation was for 45 minutes at room temperature.
6. Plate was washed as described in step 4.
7. 100 μl/well alkaline phosphatase conjugated goat anti-rabbit (Sigma) was added at an appropriate dilution in PBSTA and incubated for 45 minutes at room temperature.
8. Plate was washed as described previously.
9. Alkaline phosphatase activity was detected by adding 100 μl/well substrate solution: 1 mg/ml pNPP in IM diethanolamine, 1 mM $MgCl_2$.
10. Absorbance was read at 405 nm when the colour had developed.

2.1.1.4 mRNA Isolation and cDNA Synthesis $4\times10^8$ PBLs were isolated using a ficoll gradient and total RNA was isolated based on the method of Chomczynnski and Sacchi, (1987) Anal. Biochem., 162, 156–159.

mRNA was subsequently prepared using Oligotex mRNA Qiagen Purification kit.

cDNA was synthesised using First Strand Synthesis for RT-PCR kit from Amersham (RPN 1266) and the oligo dT primer using approximately 2 μg mRNA (1 μg/Eppendorf) as estimated from the total RNA concentration and assuming that mRNA constitutes approximately 1% of the total RNA.

2.1.1.5 Isolation of Short and Long-Hinge HCVs by PCR

A master mix for the amplification of short and long-hinge PCR was prepared as follows:

4611 dNTP mix (5 mM)

11.5 μl LAM 07 or LAM 08 (100 pmol/μl)

LAM 08 3'primer (short hinge)

5' AACAGTTAAGCTTCCGCTTGCGGCCGCGGAGCTGGGGTCTTCGCTGTGGTGCG '3

5' ACAGTTAAGCTTCCGCTTGCGGCCGCTGGTTGTGGTTTTGGTGTCTTGGGTT '3

11.5 μl $V_H$ 2B (100 pmol/μl)

$V_H$ 2B 5' primer

5' AGGTSMARCTGCAGSAGTCWGG '3

S=C/G, M=A/C, W=A/T, R=A/G

115 μl $MgCl_2$ (25 mM)

161 μl dep water 20 tubes for both short and long-hinge amplification were prepared containing 15 μl/Eppendorf of the above master mix and 1 ampliwax (Perkin Elmer). Tubes were incubated for 5 minutes at 75° C. to melt the wax and then placed on ice.

35 μl of the following appropriate mix was added to each Eppendorf:

200 μl 5× stoffel buffer (Perkin Elmer)

20 μl Amplitaq DNA polymerase stoffel fragment (Perkin Elmer)

1140 μl dep water

40 μl cDNA

Negative controls had the cDNA omitted and replaced with water. The reactions conditions were:

| | |
|---|---|
| 1 cycle at | 94° C. 5 minutes |
| 35 cycles at | {94° C. 1 minute<br>{55° C. 1.5 minutes<br>{77° C. 2 minutes |
| 1 cycle at | 72° C. 5 minutes |

Identical reactions were pooled and 5 μl was analysed on a 2% agarose gel.

2.1.1.6 Restriction Enzyme Digestion of VHHs and pUR4536

Pooled llama short and long-hinge PCR products were purified from a 2% agarose gel using Qiaex II purification kit (Qiagen) and resuspended in a final volume of 80 μl. 50 μl of this sample was digested using Hind III (Gibco BRL) and Pst 1 (Gibco BRL) according to the manufacturer's instructions. Digested PCR products were again purified as detailed above.

2.1.1.7 Generation of Short and Long-Hinge VHH Libraries

Appropriate ratios of PCR product were combined with digested vector using DNA ligase (Gibco BRL) according to the manufacturer's instructions. Ligation reactions were purified and used to transform electrocompetent *E. coli* XL-1 Blue (Stratagene).

2.1.1.8 Phage Rescue Maxiscale 15 ml 16 g Tryptone, 10 g Yeast extract, 5 g NaCl per liter containing 2% glucose and 100 μg/ml ampicillin (2TY/Amp/Glucose) was inoculated with 100 μl of glycerol stock of either short or long-hinge VHH library and phage rescues were performed. The cells were grown until thin log phase was reached and infected with M13K07 helper phage (Gibco BRL). Infected cells were pelleted and resuspended in 2TY/Amp/Kan to allow release of phage into the supernatant. After overnight incubation at 37° C., phage were pelleted and concentrated by PEG precipitation. The final phage pellet was resuspended in 1 ml PBS in 2% BSA/1% marvel, or 2% ovalbumin/1% marvel as appropriate, and incubated for approximately 30 minutes at room temperature.

2.1.1.9 Selection of Antigen Binding Phages: Panning

Nunc-immunotubes were sensitised with either 2 ml of red wine, or PBSA only (as a negative control) for 1 week at 37° C. The tubes were washed with PBSA and preblocked with 2 ml 2% BSA/1% marvel in PBSTA at room temperature for about 3 hours.

Blocking solution was removed and 100 μl blocked phage solution in a total volume of 0.075% LAS/CoCo in 2% BSA/1% marvel added to the immunotubes. Samples were incubated for 3.5 hours at room temperature.

The tubes were washed 20× with PBST and 20× with PBS. Bound phage were removed from the surfaces with 0.5 ml 0.2M glycine/0.1M HCl pH2.2 containing 10 mg/ml BSA, and incubating at room temperature for 15 minutes. The solutions were removed into fresh tubes and neutralised with 30 μl 2M Tris. *E. coli* XL-1 Blue were infected with eluted phage.

2.1.1.10 Generation of Soluble HCV Fragments

DNA was isolated from the panned library using Qiagen midi-prep kit used to transform $CaCl_2$ competent *E. coli* D29A1, which were plated out on SOBAG plates and grown overnight at 37° C. Individual colonies of freshly transformed *E. coli* D29A1 were picked and VHH expression induced using IPTG.

2.1.1.11 Detection of Expression of Anti-Polyphenol VHH-myc Constructs

Greiner microtitre plates were sensitised with 100 μl/well red wine, as well as other sources of polyphenols or PBSA only for about 60 hours at 37° C. Plates were blocked with 200 μl/well 1% BSA/PBSTA for 1 hour at 37° C. 65 μl crude *E. coli* supernatant was pre-mixed with 32 μl 2% BSA/PBSTA and added to the appropriate wells of the blocked plates. VHHs were allowed to bind to the antigens for 2 hours at 37° C. Unbound fragments were removed by washing 4× with PBSTA. 1001 μl/well of an appropriate dilution of mouse anti-myc antibody in 1% BSA/PBSTA was added and incubated for 1 hour at 37° C. Plates were washed as previously and 100 μl/well of an appropriate dilution of alkaline phosphatase conjugated goat anti-mouse (Jackson) in 1% BSA/PBSTA added and incubated as before. Plates were again washed and alkaline phosphatase activity was detected by adding 100 μl/well substrate solution: 1 mg/ml pNPP in μM diethanolamine/l MM $MgCl_2$. When the colour had developed an absorbance reading at 405 nm was taken.

2.1.2 Preparation of Anti-GOx VHH Fragments

A llama, kept at the Dutch Institute for Animal Science and Health (ID-DLO, Lelystad) was immunised with equimolar amounts of two different GOx preparations: Novo and Amano.

The llama was immunised and then boosted twice more, one month apart, prior to removal of peripheral blood lymphocytes (PBLs) for RNA isolation.

Libraries of short and long-hinge VHHs were constructed as described for the red wine VHHs above. Libraries were panned against immunotubes (Nunc) sensitised with either 2 ml of 20 μg/ml GOx (Novo) or PBSa only (negative control). DNA from the panned libraries was isolated and used to transform *E. coli* D29A1. Individual colonies were picked and soluble VHH fragments generated exactly as described above.

2.1.2.1 Detection of Expression of Anti-GOx VHH-myc Constructs.

High binding capacity microtitre plates (Greiner) were sensitised with 100 μl/well either 10 μg/ml GOx (Novo) or PBSa only overnight at 37° C. Plates were blocked with 200 μl/well 1% BSA/PBSTA for 1 hour at 37° C. 80 μl crude *E. coli* supernatant was pre-mixed with 40 μl 2% BSA/PBSTA and added to the appropriate wells of the blocked plates. VHHs were allowed to bind for 2 hours at 37° C. Binding of VHHs to Gox was detected as described for the VHHs binding to red wine.

2.1.3 Construction of RW/GOx Bi-Head Expression Vectors

Figure 7:
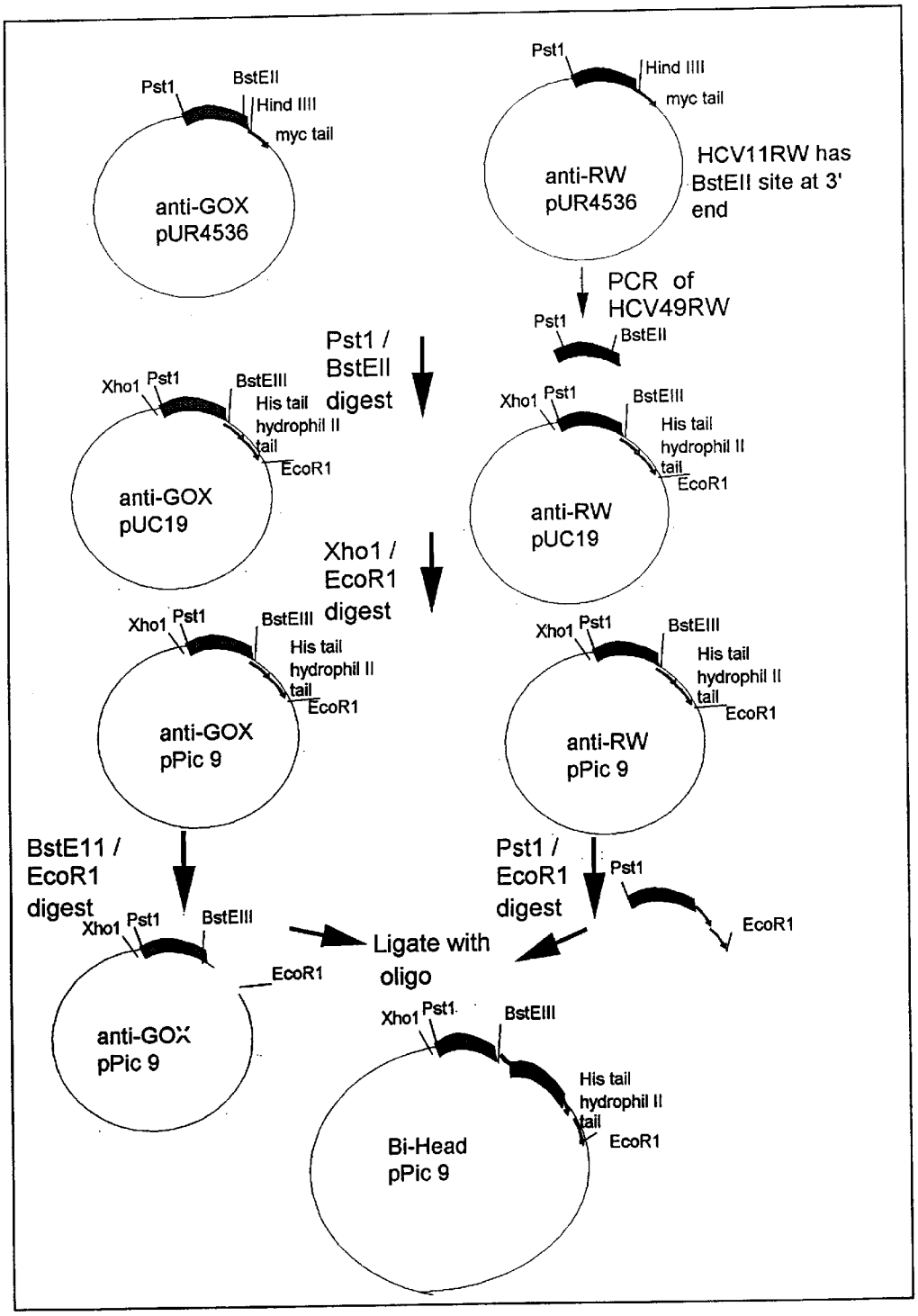
FIG. 7 gives a diagrammatic view of a cloning strategy to obtain a bi-head antibody.

The strategy for cloning of bi-head molecules is shown diagramatically in FIG. 7.

2.1.3.1 PCR of VHH49RW

HCV49RW was PCR amplified using primers 51 and HCV 3'

```
Primer 51

5' AGGTCAAACTGCAGCAGTCAGG
       GC  G     G    T

HCV 3'

5' TCCTGAGGAGACGGTGACCTGGGTCCCCTG '3
```

The reaction mixture for amplification was 10 pmoles each primer, 1×Pfu buffer (Stratagene), 0.2 mM dNTPs, 0.2 μl VHH49RW midiprep DNA, 1 μl Pfu enzyme (Stratagene), water to 50 μl. The reaction conditions were:

| | |
|---|---|
| 94° C. for 4 mins | |
| 94° C. for 1 min | } |
| 55° C. for 1 min | } 33 cycles |
| 72° C. for 1 min | } |
| 72° C. for 10 mins | |

2.1.3.2 Cloning of VHHs into pPic Yeast Expression Vector

VHH12GOx was excised from the plasmid pUR4536 using Pst1 and BstEII according to the manufacturers instructions. The PCR fragment of VHH49RW was similarly digested. All excised fragments were purified from a 1% agarose gel using Qiaex II purification kit (Qiagen).

Fragments were then cloned into the modified vector, pUC19 (containing an Xho1 restriction site at the 5' end of a previously cloned VHH and a hydrophil II tail for detection), which had also been digested with Pst1 and BstEII. Ligation was performed using DNA ligase (Gibco BRL) according to the manufacturers instructions. Calcium chloride competent *E. coli* TG1 were transformed with a portion of the ligation reaction. To select clones containing the correct inserts, single colonies were picked, DNA isolated, and diagnostic restriction enzyme analysis performed using Pst1 and BstEII. To verify the inserts, DNA was sequenced by automated dideoxy sequencing (Applied Biosystems).

VHHs were subsequently excised from the pUC19 vectors using sequential digests with Xho1 and EcoR1 and the buffers recommended by the enzyme manufacturers. pPic9 vector (Invitrogen) was similarly digested and the digested VHHs inserted into this vector as described for cloning into pUC19. Clones containing the correct inserts were again determined using diagnostic digests with Xho1 and EcoR1, and DNA sequencing.

To create the bi-head constructs the anti-polyphenol VHH49RW and the anti-GOx VHH12GOx were combined in the same pPic9 DNA vector. pPic9 vector containing anti-GOx VHH was digested with BstEII and EcoR1 to remove an 85bp fragment. pPic9 vector containing VHH49RW was digested with Pst1 and EcoR1 to release the VHH. All restriction enzyme digestions were sequential using appropriate buffers as recommended by the manufacturers. Digested vector and VHH were purified using Qiaex II purification kit (Qiagen).

Two oligonucleotides, containing a 5' BstEII and a 3' Pst1 overhang (GTCACCGT CTCCTCACAGGTGCAGCTGCA, and GCAGAGGAGTGTCCACGTCG) were annealed using the following mix:

1 μg each oligonucleotide
1 μl 10× ligase buffer (Promega)
water to 10μl.

The mix was boiled for 1 minute and then allowed to cool over approximately 30 minutes. 190 μl water was added. Different ratios of VHH49RW and VHH12Gox containing vector were added. The three-point ligation reactions were performed using the conditions previously described. 100 μl calcium chloride competent *E. coli* XL-1Blue was transformed with 4 μl ligation reaction. Identification of clones containing both VHHs was performed using primers 392 and 393.

```
Primer 392
5' GCAAATGGCATTCTGACATCC '3

Primer 393
5' TACTATTGCCAGCATTGCTGC 3'
```

Figure 8:
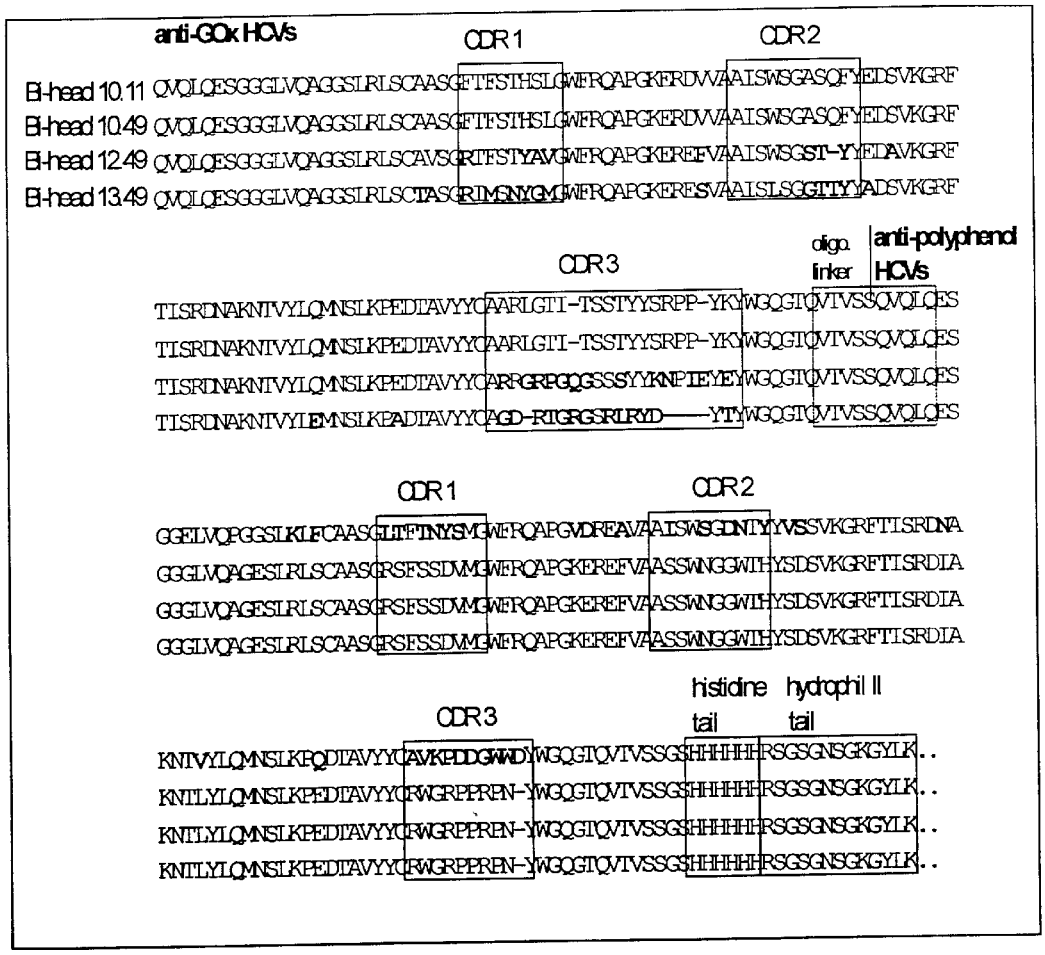
FIG. 8 shows the alignment of bi-head predicted amino acid sequences. The kabat CDRs, purification and detection tails are boxed, amino acid differences are in bold type.

Amplified DNA was analysed on a 1% agarose gel and vectors containing bi-heads identified according to size. Appropriate clones were further confirmed by diagnostic restriction enzyme digests of the PCR products with Pst1 and BstEII simultaneously, and dideoxy Sanger sequencing using primers 392 and 393. The predicted amino acid sequence of bihead 12.49 is shown in FIG. 8.

2.2 Expression of Bi-Heads in *Pichia pastoris* pPic9 vectors containing bi-head DNA was transformed into the methylotrophic yeast, *Pichia pastoris*. 10 μg vector DNA was digested with the DNA restriction enzyme Bgl II, purified by phenol extraction, ethanol precipitated, and used to transform electrocompetent *P. pastoris* strain GS115 (Invitrogen). Cells were grown for 48 hours at 30° C. on MD plates (1.34% TND, $5\times10^{-5}$% biotin, 0.5% methanol, 0.15% agar) and then $Mut^+/Mut^s$ colonies selected by patching on both an MM plate (1.34% TND, $5\times10^{-5}$% biotin, 1% glucose, 0.15% agar) and an MD plate. Colonies that grow normally on the MD plates but grow very slowly on the MM plates are the $Mut^s$ clones.

A single colony from the MD plates was used to inoculate 10 ml BMGY medium (1% yeast extract, 2% peptone, 100 mM potassium phosphate pH 6.0, 1.34% YNB, $5\times10^{-5}$% biotin, 1% glycerol) in a 50 ml Falcon tube. Expression of the bi-heads was induced by the addition of methanol after allowing the colonies to reach log phase. Supernatants were harvested by centrifugation and analysed.

2.3 Activating a Surface with a Bi-Headed Antibody Fragement

Red wine was incubated overnight at 37° C. on a Nunc microtitre plate at 200 μl/well and plates were then stored at 4° C. until required. Plates were washed once with phosphate buffered saline containing 0.15% (v/v) Tween 20 and 0.02% thiomersal (PBSTM) and incubated with bi-head 12.49 at various dilutions from a culture supernatant (at a stock concentration of about 1 mg/ml). After 20 minutes the wells of the microtitre plate were washed three times by the addition of 200 μl PBSTM.

2.4 Scavenging Glucose Oxidase from a Solution and Subsequent Detection

Figure 9:
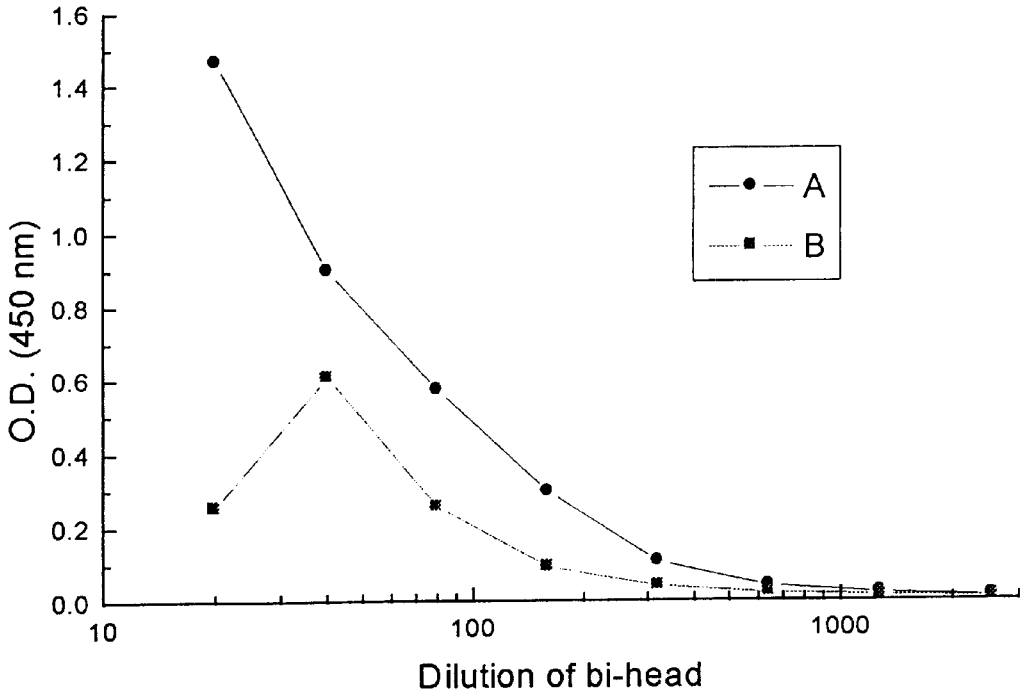
FIG. 9 shows that a red wine surface activated with bi-head antibody (FIG. 9A) can scavenge more glucose oxidase than can be bound to a wine surface when bi-head and glucose oxidase are mixed together in a single step (FIG. 9B).

A solution of glucose oxidase (Novo) was incubated at 100 μl/well (20 μg/ml diluted in PBSTM) for 15 minutes at room temperature. The wells were then washed three times by the addition of 200 μl PBSTM and then incubated with 100 μl/well of substrate solution comprising, 20 mM glucose, 10 g/ml tetra methyl benzidine, 1 μg/ml horseradish peroxidase in 0.1 M phosphate buffer at pH 6.5. After 10 minutes 100 μl 1 M HCl was added per well and the optical density at 450 nm was determined. For comparison, following the binding of red wine to the microtitre plate a solution, comprising a mixture of bi-head at various dilutions and glucose oxidase at 20 μg/ml diluted in PBSTM, was incubated for 15 minutes and the plate washed as described above. FIG. 9 shows that a red wine surface activated with bi-head (FIG. 9A) can scavenge more glucose oxidase than can be bound to a wine surface when bi-head and glucose oxidase are mixed together in a single step (FIG. 9B).

EXAMPLE 3

Scavenging Glucose Oxidase from Solution Onto Red Wine Activated Cotton 3.1 Activating a Cotton Surface with a Bi-Headed Antibody Fragment Cotton sheets (approx. 20×10 cm) were stained with red wine by immersion of the sheets in red wine for 2 hours at 37° C. The stained sheets were allowed to air dry at 37° C. and then stored in the dark for 4 days in sealed foil bags. Stained sheets were stored in foil bags until required at −20° C. Stained cotton swatches were prepared by punching circular discs of fabric from the sheets using a hole puncher. Swatches were pre-washed in 0.1 M sodium carbonate buffer pH 9.0 and a Nunc microtitre plate was blocked by incubation of wells with 200 μl of 1% (w/v) Marvel. Swatches were placed in the wells of the microtitre plate and 100 μl bi-head 12.49 at 5 μg/ml in 0.1 M sodium carbonate buffer pH 9.0 was added per well. After a 15 minute incubation at room temperature the swatches were washed three times with 0.1 M sodium carbonate buffer pH 9.0.

3.2 Scavenging Glucose Oxidase from a Solution and Subsequent Bleaching of Red Wine Stain A solution of glucose oxidase (100 μl aliquot at 50 μg/ml in 0.1 M sodium carbonate buffer pH 9.0) was incubated with the activated swatch in the well of a microtitre plate for 15 minutes at 37° C. The swatches were then washed three times in 0.1 M sodium carbonate buffer pH 9.0 and then 25 μl of glucose (80 mM) was added to each swatch and incubated at room temperature for 60 minutes. The swatches were washed with distilled $H_2O$ five times and then dried at 37° C. Images of the swatches were then scanned on a Hewlet Packard ScanJet ADF digital scanner. For comparison pre-washed swatches which had not been exposed to bi-head were incubated with a mixture of bi-head 12.49 (5 μg/ml), glucose oxidase (50 μg/ml) and glucose (80 mM) at room temperature for 60 minutes. These swatches were washed in $H_2O$ and dried as above. The samples that were pre-activated with binding molecules gave superior bleaching results when compared to untreated ones. This demonstrates the advantage of pre-activating a surface to capture a benefit agent which can then exert or perform its desired effect at the specificed site or region.

EXAMPLE 4

The Capture of Oil Bodies on Fabric

The experiment exemplifies capture of particles (plant oil bodies) on cotton fabric which has been preprepared with a biorecognition molecule able to bind to cotton and specifically scavenge particles from the surrounding environment.

1.1 Oil Body Isolation

Oil bodies were isolated from rape seeds essentially as described by Tzen et al. (J. Biol. Chem. 267, 15626–15634). Briefly rape seeds were ground to a fine powder in liquid nitrogen using a pestle and mortar, and sieved. 1 g crushed seed was homogenised in 4 g grinding medium, on ice. The sample was mixed with an equal volume of floating medium containing 0.6M sucrose, and centrifuged. The 'fat pad' was removed to another tube, resuspended in floating medium containing 0.25M sucrose, and centrifuged. The 'fat pad' was collected and stored at 4° C.

1.2 Preparation of Oil Bodies Containing Nile Red

In order to be able to visualise the presence of oil bodies on skin or cotton, they were prepared containing the lipophilic reagent, nile red, which is a fluorescent label.

A crystal of nile red was added to a 2% suspension of oil bodies in water. The sample was vortexed for 2 minutes and centrifuged at 13,000 rpm for 2 minutes. The upper layer containing the oil bodies was removed and washed with phosphate buffered saline (PBS) (0.24 g $NaH_2PO_4.H_2O$, 0.49g $Na_2HPO_4$ anhydrous, 4.25 g NaCl, in 1 L water, pH7.1) 3 times. After the final wash, the oil bodies were resuspended in 5 ml PBS.

1.3 Sensitisation of Oil Bodies with Reactive Red 6 and Nile Red

An antibody to the azo-dye reactive red 6 (RR6) (ICI) was available, therefore, oil bodies was sensitised with RR6 in order to be able to study specific deposition of oil bodies to surfaces.

0.1 g oil bodies were resuspended in 4.8 ml 0.1M $Na_2B_4O_7.10H_2O$, 0.05M NaCl pH8.5, and 0.2 ml 2% RR6 in water. The suspension was rotated overnight at room temperature. The sample was centrifuged at 13000 rpm for 2 minutes, and the upper layer removed and nile red added as described above.

1.4 Generation of Anti-RR6 VHH-Anti-Keratin VHH-CBD

Scavenging of oil bodies from solution and capture on cotton was performed using a molecule which had 2 VHH specificities fused to CBD (αRR6 VHH-αkeratin VHH-CBD).

1.4.1. Preparation of a Keratin Specific VHH from Llama 1.4.1.1 Antigen Preparation Human plantar callus corneocytes were obtained by filing. Soluble callus extract was prepared by suspending 100 mg callus corneocytes in 50 ml 20 mMTris pH7.4/8M urea/1% SDS, boiling for 15 minutes and then sonicating with an ultrasonic probe 22μ for 2 minutes. The sample was centrifuged at 1,000 g for 20 minutes at 15° C. The supernatant was recovered and dialysed against PBS overnight.

1.4.1.2 Immunisation Schedule

A llama, kept at the Dutch Institute for Animal Science and Health (ID-DLO, Lelystad), was immunised with callus corneocytes and subsequently boosted 2 times approximately 1 month apart. The serum used for library construction was removed 1 week after the second boost.

1.4.1.3 Polyclonal Sera Analysis

Sera were analysed by ELISA against callus soluble extract as follows:

1. Sterilin microtitre plate (Sero-Wel) was sensitised with 100 μl/well 25 μg/ml callus extract in PBS. Plates were incubated overnight at 4° C. and then washed in PBS.
2. The plate was blocked by preincubating with 200 μl/well 1% marvel in PBS containing 0.15% Tween (PBST) for 1 hour at 37° C.
3. Blocking buffer was removed and 100 μl/well llama immunised sera or prebleed, beginning with a $10^{-1}$ dilution in PBS, added. Incubations were for 1 hour at 37° C.
4. Unbound antibody fragment was removed by washing 4× using a plate washer in PBST.
5. 10 μl/well of rabbit anti-llama VHH was added at an appropriate dilution in PBST. Incubation was for 1 hour at 37° C.
6. Plate was washed as described in step 3.
7. 100 μl/well alkaline phosphatase conjugated goat anti-rabbit (Jackson) was added at an appropriate dilution in PBSTa and incubated for 1 hour at 37° C.
8. Plate was washed as described previously.
9. Alkaline phosphatase activity was detected by adding 100 μl/well substrate solution: 1 mg/ml pNPP in 1M diethanolamine, 1 mM $MgCl_2$.
10. Absorbance was read at 405 nm when the colour had developed.

1.4.1.4 mRNA Isolation and cDNA Synthesis $2.5\times10^8$ peripheral blood lymphocytes (PBLs) were isolated using a ficoll gradient. RNA was isolated based on the method of Chomczynnski and Sacchi, (1997) Anal. Biochem., vol 162, pp 156–159. mRNA was subsequently prepared using Oligotex mRNA Qiagen Purification kit.

cDNA was synthesised using First Strand Synthesis for RT-PCR kit from Amersham (RPN 1266) and the oligo dT primer. Approximately 2 μg mRNA was used (1 μg /Eppendorf) as estimated from the total RNA concentration and assuming that mRNA constitutes 1% of the total RNA.

1.4.1.5 Isolation of Short and Long-Hinge VHHs by PCR

A master mix for the amplification of short and long-hinge PCR was prepared as follows:

46 μl dNTP mix (5 mM)
11.5 μl LAM 07 or LAM 08 (100 pmol/l)

Negative controls had the cDNA omitted and replaced with dep water. The reaction conditions were: 1 cycle at 94° C. 5 minutes; 35 cycles at (94° C. 1 minute; 55° C. 1.5 minutes; 77° C. 2 minutes) and 1 cycle at 72° C. 5 minutes. Identical reactions were pooled and 5 μl was analysed on a 2% agarose gel.

1.4.1.6 Restriction Enzyme Digestion of VHHs and pUR4536

Figure 10:
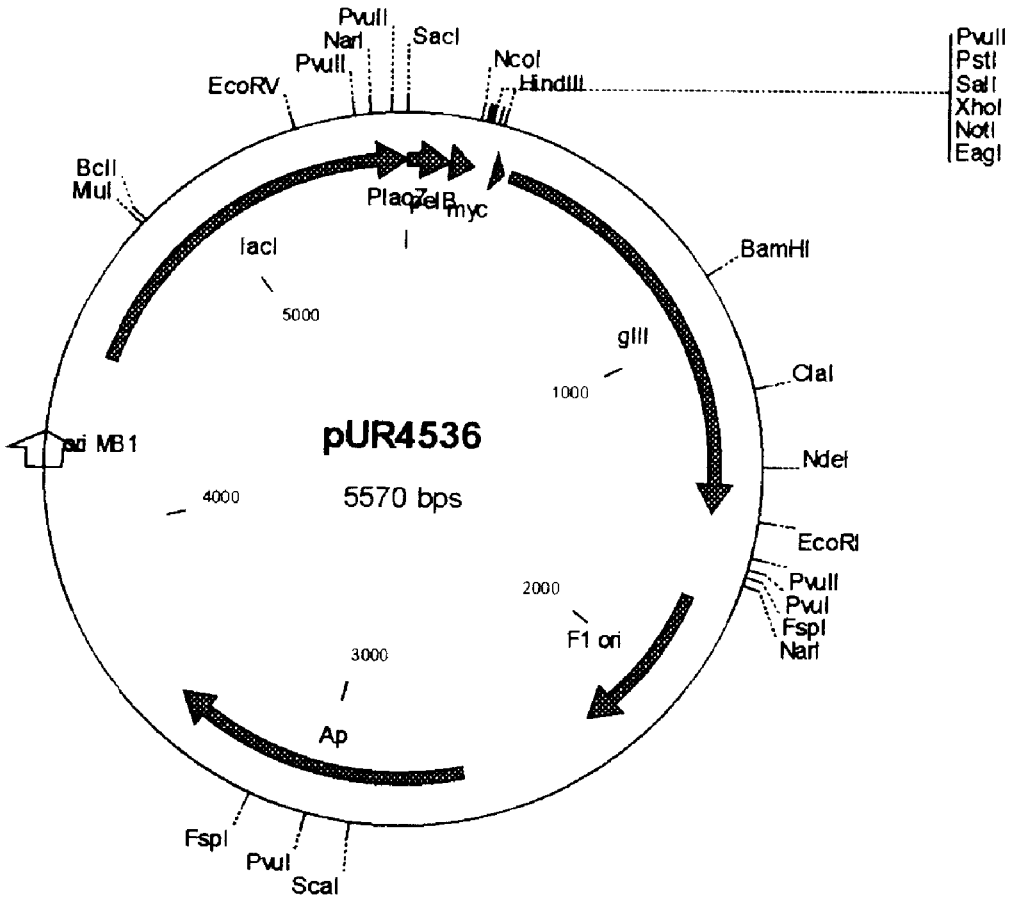
FIG. 10 shows the DNA construct pUR4536.

Pooled llama short and long-hinge PCR products were purified from a 2% agarose gel using Qiaex II purification kit (Qiagen) and resuspended in a final volume of 80 μl. 40 μl of this sample was digested using Hind III and Pst1 (Gibco BRL) according to manufacturer's instructions. Digested PCR products were again purified as detailed above. pUR4536 (FIG. 10) was similarly digested and purified.

1.4.1.7 Generation of Short and Long-Hinge VHH Libraries

Appropriate ratios of PCR product were combined with digested vector using DNA ligase (Gibco BRL) according to manufacturer's instructions. Ligation reactions were purified and used to transform electrocompetent *E. coli* JM109.

1.4.1.8 Phage Rescue Maxiscale 15 ml 2TY/Amp/Glucose (16 g Tryptone, 10g yeast extract, 5 g NaCl per liter, containing 2% glucose and 100 μg/ml ampicillin) was inoculated with 100 μl of glycerol stock of either short or long-hinge VHH library and phage rescues were performed. The cells were grown until log phase was reached and infected with M13K07 helper phage (Gibco BRL). Infected cells were pelleted and resuspended in 2TY/Amp/Kan to allow release of phage into the supernatant. After overnight incubation at 37° C., phage were pelleted and concentrated by PEG precipitation. The final phage pellet was resuspended in 3 ml PBS in 2% BSA/1% marvel and incubated for approximately 30 minutes at room temperature.

1.4.1.9 Selection of Antigen Binding Phages: Panning

Nunc-immunotubes were sensitised with either 1 ml of 50 μg/ml soluble callus extract in PBS, or PBS only (as a negative control) overnight at 4° C. The tubes were washed with PBS and preblocked with 2 ml 2% BSA/1% marvel in PBST at room temperature for about 3 hours.

Blocking solution was removed and 1 ml of blocked phage solution was added to the immunotubes. Samples were incubated for 4 hours at room temperature.

```
LAM 07: 5'
     AACAGTTAAGCTTCCGCTTGCGGCCGCGGAGCTGGGGTCTTCGCTGTGGTGCG

LAM 08: 5'
     AACAGTTAAGCTTCCGCTTGCGGCCGCTGGTTGTGGTTTTGGTGTCTTGGGTT
```

11.5 μl VH2B (100 pmol/μl)
VH2B: 5' AGGTSMARCTGCAGSAGTCWGG
S=C/G, M=A/C, W=A/T, R=A/G
115 μl $MgCl_2$ (25 mM)
161 μl dep water 20 tubes for both short and long-hinge amplification were prepared containing 15 μl/Eppendorf of the above master mix and 1 ampliwax (Perkin Elmer). Tubes were incubated for 5 minutes at 75° C. to melt the wax and then placed on ice.

35 μl of the following appropriate mix was added to each Eppendorf:

200 μl 5× stoffel buffer (Perkin Elmer)
20 μl Amplitaq DNA polymerase stoffel fragment (Perkin Elmer)
1140 μl dep water
40 μl cDNA The tubes were washed 20× with PBST and 20× with PBS. Bound phage were removed with 0.5 ml 0.2M glycine/0.1M HCl pH2.2 containing 10 mg/ml BSA, and incubating at room temperature for 15 minutes. The solution was removed into a fresh tube and neutralised with 30 μl 2M Tris. 200 μl 1M Tris pH7.5 was added to the tubes.

The eluted phage were added to 9 ml log-phase *E. coli* XL-1 Blue. 4 ml log-phase *E. coli* was also added to the immunotubes. Cultures were incubated for 30 minutes at 37° C. without shaking to allow for phage infection of the *E. coli.*

The cultures were pooled as appropriate, pelleted, resuspended in 2TY and plated out on SOBAG plates (20 g bacttryptone, 5 g bacto-yeast extract, 0.5 g NaCl per liter, 10 mM $MgCl_2$, 1% glucose, 100 μg/ml ampicillin) for harvesting and the panning process was repeated a further 2 times.

1.4.1.10 Generation of Soluble VHH Fragments

Clones from the panned libraries were harvested and DNA was isolated from the cell pellets using Qiagen midi-prep kit. DNA from each panned library was used to transform $CaCl_2$ competent *E. coli* D29A1, which were plated out on SOBAG plates and grown overnight at 37° C. Individual colonies of freshly transformed *E. coli* D29A1 were picked and VHH expression induced on a microtitre plate scale using IPTG.

1.4.1.11 Detection of Expression of Anti-Skin VHH-myc Constructs

Sterilin microtitre plate (Sero-Wel) was sensitised with either callus soluble extract or PBS only. Plates were blocked with 200 μl/well 1% BSA/PBST for 1 hour at 37° C. 90 μl crude *E. coli* supernatant was premixed with 45 μl 2% BSA/PBS and added to the appropriate wells of the blocked plates. Incubation was for 2 hours at 37° C. Unbound fragment was removed by washing 4× with PBST. 100 μl/well of an appropriate dilution of mouse anti-myc antibody (in house) in 1% BSA/PBST was added and incubated for 1 hour at 37° C. Plates were washed as previously and 100 μl/well of an appropriate dilution of alkaline phosphatase conjugated goat anti-mouse (Jackson) in 1% BSA/PBST added and incubated as before. Plates were again washed and alkaline phosphatase activity was detected by adding 100 μl/well substrate solution: 1 mg/ml pNPP in 1M diethanolamine/1 mM $MgCl_2$. When the colour had developed an absorbance reading at 405 nm was taken. The clone VHH8 was identified as specifically binding to epidermal keratin.

1.4.2 Preparation of Anti-RR6 Specific VHH from Llama

Anti-RR6 VHH was isolated similarly to that of anti-keratin VHH as described by Linden, R (Unique characteristics of llama heavy chain antibodies, PhD Thesis, Utrecht University, Netherlands, 1999).

1.4.3 Construction of Anti-RR6-Anti-Keratin-CBD

Figure 11:
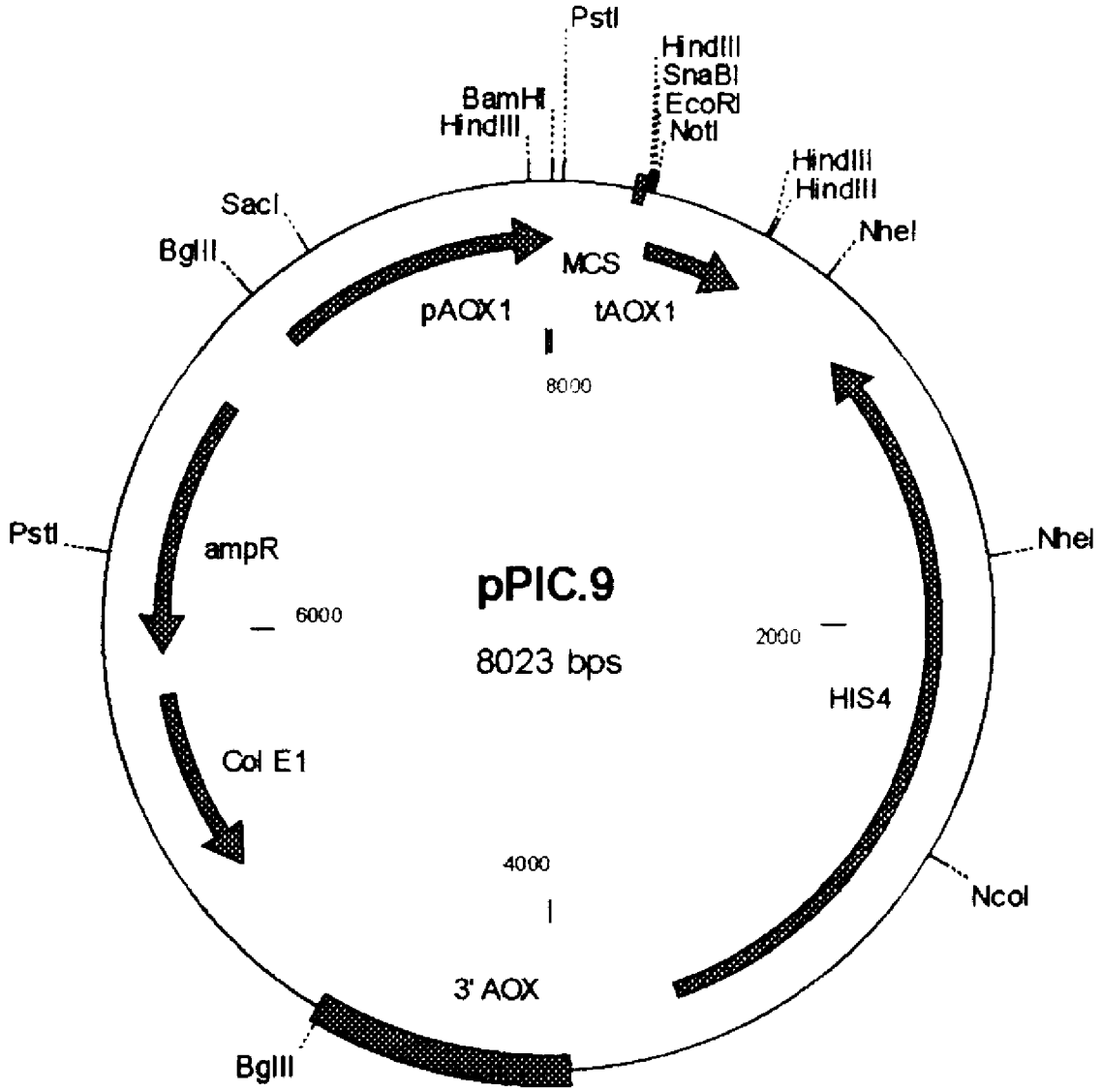
FIG. 11 shows the DNA construct pPIC9.

Anti-RR6VHH was genetically fused to 6 histidines (for purification purposes) and CBD derived from *Trichoderma reesei* (Linder M. et al, Protein Science, 1995, vol 4, pp. 1056–1064), and cloned into pPic9 (FIG. 11). VHH8 (anti-keratin) was subsequently isolated from pur4536 by restriction enzyme digestion. Using BstEII, VHH8 was ligated between the anti-RR6 VHH and CBD sequence in pPic9. The clone was expressed in *Pichia pastoris*. The DNA sequence is shown in FIG. 12.

1.5 Production and Analysis of Triple Head Biorecognition Molecule.

1.5.1 Transformation and Selection of Transformed *P. pastoris* Cells

Approximately 2–5 μg DNA in 2 μl water (TthIIIi, Sac1 digested) pPic9 construct was used to transform electrocompetent *P. pastoris* GS115 (Invitrogen) according to manufacturer's instructions.

1.5.2 Production and Evaluation of Anti-RR6-VHH8-CBD

Transformed and selected *P. pastoris* clones were induced to express antibody using the protocol outlined below:

1) Using a single colony from the MD plate, inoculate 10 ml of BMGY (1% Yeast Extract, 2% Peptone, 100 mM potassium phosphate pH6.0, 1.34% YNB, 4×l 0–5% Biotin, 1% Glycerol) in a 50 ml Falcon tube.
2) Grow at 30° C. in a shaking incubator (250 rpm) until the culture reaches an OD600~2-8.
3) Spin the cultures at 2000 g for 5 minutes and re-suspend the cells in 2 ml of BMMY medium (1% Yeast Extract, 2% Peptone, 100mM potassium phosphate pH6.0, 1.34% YNB, 4×10–5% Biotin, 0.5% Glycerol).
4) Return the cultures to the incubator.
5) Add 20 μl of MeOH to the cultures after 24 hours to maintain induction.
6) After 48 hours harvest the supernatant by removing the cells by centrifugation.

The crude supernatants were tested for the presence of antibody construct via analysis on 12% acrylamide gels using the Bio-Rad mini-Protean II system. VHH8 activity was detected as described section 1.4.1.11. Anti-RR6 activity was detected as follows:

1) 96 well ELISA plates (Greiner HB plates) were sensitised overnight at 37° C. with 100 μl/well of BSA-RR6 conjugate (azo-dye RR6 (ICI) which was coupled to BSA via its reactive triazine group)

in PBS, or PBS only.

2) Following one wash with PBST the wells were incubated for 1 hour at 37° C. with 100 μl blocking buffer (1% BSA in PBST) per well.
3) Test supernatants (50 μl) were mixed with equal volumes of blocking buffer and added to the sensitised ELISA wells. Incubated at 37° C. for 1 hour.
4) Following 4 washes with PBST, 100 μl rabbit anti-llama polyclonal sera (in house) was added at an appropriate dilution in blocking buffer. Incubated at 37° C. for 1 hour.
5) Following four washes with PBST, goat anti-rabbit conjugated to alkaline phosphatase (Zymed) was added at an appropriate dilution in blocking buffer. Incubated at 37° C. for 1 hour.
6) After washing 4 times with PBST, 100 μl/well pNPP substrate (1 mg/ml pNPP in 1M diethanolamine/1 mM $MgCl_2$) was added to each well. When colour had developed, plates were read at 405 nm.

CBD binding activity was detected as follows:

1) 20 μl 1% ethylcellulose and 80 μl 0.1% marvel in PBST (blocking buffer), or blocking buffer only, were added to wells of an MAHV 0.45μ filter plate (Millipore). Incubated for 1 hour at room temperature with shaking.
2) Buffer was removed using a vacuum manifold.
3) Test supernatants (50 μl) were mixed with equal volumes of blocking buffer and added to the ELISA wells. Incubated at room temperature for 1 hour, with shaking.
4) Following 10 washes with PBST, 100 μl rabbit anti-llama polyclonal sera (in house) was added at an appropriate dilution in blocking buffer. Incubated at room temperature for 1 hour, with shaking.
5) Following 10 washes with PBST goat anti-rabbit conjugated to alkaline phosphatase (Zymed) was added at an appropriate dilution in blocking buffer. Incubated at room temperature for 1 hour, with shaking.
6) After washing 10 times with PBST, 100 μl/well pNPP substrate (1 mg/ml pNPP in 1M diethanolamine/1 mM $MgCl_2$) was added to each well. When colour had developed, substrate was removed to a new solid ELISA plate and optical density was measured at 405 nm.

1.5.3 Large Scale Expression of Construct

The clone giving the best expression levels and binding activities was selected and produced on 31 fermentation scale in a fermenter. Purification was via the histidine tail using IMAC (Immobilised metal affinity chromatography).

1.6 Targeting of Oil Bodies to Cotton

Multiples of 4 lots of 2 cm lengths of cotton fibres were placed in 3 ml volume glass vials. The cotton was prewashed for 30 minutes in 1 ml PBST with shaking. The buffer was decanted and replaced with 1 ml of 25 μg/ml anti-RR6-VHH8-CBD in PBS containing the detergent 0.15% Tween (PBST) or PBST only. Incubation was for 1 hour at room temperature with shaking. The samples were washed 3×5 minutes with 1 ml PBST, shaking at room temperature. Samples were then incubated for 1 hour, room temperature, with shaking, with either of the following:

100 μl oil bodies containing nile red and 900 μl PBST
100 μl oil bodies containing nile red, sensitised with RR6 and
900 μl PBST
1 ml PBST only.

Samples were washed 3×10 minutes with 1 ml PBST, followed by 3 ml PBST for 10 minutes, with shaking at room temperature.

1.6.1 Image Analysis

A single strand of treated cotton was laid onto a slide and a coverslip gently placed on top. The slides were viewed using a Bio-Rad MRC600 Confocal Scanning Laser Microscope (Bio-Rad Laboratories Ltd), attached to an Ortholux II microscope (Leica Microsystems UK Ltd), with 488 nm laser excitation. A ×4/0.12 LEITZ Plan objective (2) was used with a zoom factor of 2.0 to image the slides. Four areas were taken along each cotton strand at approximately equal distances. Each image area taken was 1795×1197 μm. The black and gain levels for each set of images were set up using the negative control and then kept constant for the remainder of the samples.

The Bio-Rad CoMos software was used to capture, store and analyse the images. An image was opened and the Enhance and then Histogram options selected. A box was drawn and the aspect ratio changed to a square. This box was then resized to 150×150 O pixels (12,2937.88 $\mu m^2$), which was used for all the measurements. The box was positioned five times randomly along the length of the fibre and the average pixel intensity within this box taken at each point. A visual record of each measurement area was also taken and printed. The values were exported into Microsoft Excel and the average of the average values calculated for each fibre.

Treatments involving oil bodies sensitised with RR6 cannot be directly compared to those containing nile red only, since the application of equal concentrations of the two different preparations was not strictly controlled. However, the results clearly exemplify that deposition of oil bodies is significantly enhanced if the fabric is preprepared with a biorecognition molecule able to bind both cotton and scavenge particle from an aqueous environment, in the presence of detergent. Deposition of oil bodies not sensitised with RR6, and therefore, not able to bind αRR6 VHH, was significantly less. Similarly, if no antibody was present, there was greatly reduced deposition of oil bodies. The negative controls of untreated cotton or cotton incubated with antibody only showed only very low levels of autofluorescece.

SEQUENCE LISTING

```
<160> NUMBER OF SEQ ID NOS: 34

<210> SEQ ID NO 1
<211> LENGTH: 25
<212> TYPE: DNA
<213> ORGANISM: Artificial Sequence
<220> FEATURE:
<223> OTHER INFORMATION: Description of Artificial Sequence:Primer

<400> SEQUENCE: 1

caccatctcc agagacaatg gcaag                                          25


<210> SEQ ID NO 2
<211> LENGTH: 45
<212> TYPE: DNA
<213> ORGANISM: Artificial Sequence
<220> FEATURE:
<223> OTHER INFORMATION: Description of Artificial Sequence:Primer

<400> SEQUENCE: 2

gagcgcgagc tcggccgaac cggccgatcc gccaccgcca gagcc                    45


<210> SEQ ID NO 3
<211> LENGTH: 45
<212> TYPE: DNA
<213> ORGANISM: Artificial Sequence
<220> FEATURE:
<223> OTHER INFORMATION: Description of Artificial Sequence:Primer

<400> SEQUENCE: 3

caggatccgg ccggttcggc ccaggtccag ctgcaacagt cagga                    45


<210> SEQ ID NO 4
<211> LENGTH: 53
<212> TYPE: DNA
<213> ORGANISM: Artificial Sequence
<220> FEATURE:
<223> OTHER INFORMATION: Description of Artificial Sequence:Primer
```

-continued

<400> SEQUENCE: 4 ctacatgaat tcgctagctt attatgagga gacggtgacg gtggtccctt ggc 53

<210> SEQ ID NO 5
<211> LENGTH: 36
<212> TYPE: DNA
<213> ORGANISM: Artificial Sequence
<220> FEATURE:
<223> OTHER INFORMATION: Description of Artificial Sequence:Primer

<400> SEQUENCE: 5 taataagcta gcggagctgc atgcaaattc tatttc 36

<210> SEQ ID NO 6
<211> LENGTH: 23
<212> TYPE: DNA
<213> ORGANISM: Artificial Sequence
<220> FEATURE:
<223> OTHER INFORMATION: Description of Artificial Sequence:Primer

<400> SEQUENCE: 6 accaagctcg agatcaaacg ggg 23

<210> SEQ ID NO 7
<211> LENGTH: 36
<212> TYPE: DNA
<213> ORGANISM: Artificial Sequence
<220> FEATURE:
<223> OTHER INFORMATION: Description of Artificial Sequence:Primer

<400> SEQUENCE: 7 aatgtcgaat tcgtcgactc cgccaccgcc agagcc 36

<210> SEQ ID NO 8
<211> LENGTH: 39
<212> TYPE: DNA
<213> ORGANISM: Artificial Sequence
<220> FEATURE:
<223> OTHER INFORMATION: Description of Artificial Sequence:Primer

<400> SEQUENCE: 8 attggagtcg acatcgaact cactcagtct ccattctcc 39

<210> SEQ ID NO 9
<211> LENGTH: 50
<212> TYPE: DNA
<213> ORGANISM: Artificial Sequence
<220> FEATURE:
<223> OTHER INFORMATION: Description of Artificial Sequence:Primer

<400> SEQUENCE: 9 tgaagtgaat tcgcggccgc ttattaccgt ttgatttcga gcttggtccc 50

<210> SEQ ID NO 10
<211> LENGTH: 41
<212> TYPE: DNA
<213> ORGANISM: Artificial Sequence
<220> FEATURE:
<223> OTHER INFORMATION: Description of Artificial Sequence:Primer

<400> SEQUENCE: 10 cgaattcggt caccgtctcc tcacaggtcc agttgcaaca g 41

<210> SEQ ID NO 11
<211> LENGTH: 44

-continued

<212> TYPE: DNA
<213> ORGANISM: Artificial Sequence
<220> FEATURE:
<223> OTHER INFORMATION: Description of Artificial Sequence:Primer

<400> SEQUENCE: 11 cgaattctcg agatcaaacg ggacatcgaa ctcactcagt ctcc 44

<210> SEQ ID NO 12
<211> LENGTH: 41
<212> TYPE: DNA
<213> ORGANISM: Artificial Sequence
<220> FEATURE:
<223> OTHER INFORMATION: Description of Artificial Sequence:Primer

<400> SEQUENCE: 12 cgaattcggt caccgtctcc tcacaggtgc agttgcagga g 41

<210> SEQ ID NO 13
<211> LENGTH: 22
<212> TYPE: DNA
<213> ORGANISM: Artificial Sequence
<220> FEATURE:
<223> OTHER INFORMATION: Description of Artificial Sequence:Primer

<400> SEQUENCE: 13 aggtsmamct gcagsagtcw gg 22

<210> SEQ ID NO 14
<211> LENGTH: 32
<212> TYPE: DNA
<213> ORGANISM: Artificial Sequence
<220> FEATURE:
<223> OTHER INFORMATION: Description of Artificial Sequence:Primer

<400> SEQUENCE: 14 tgaggagacg gtgaccgtgg tcccttggcc cc 32

<210> SEQ ID NO 15
<211> LENGTH: 24
<212> TYPE: DNA
<213> ORGANISM: Artificial Sequence
<220> FEATURE:
<223> OTHER INFORMATION: Description of Artificial Sequence:Primer

<400> SEQUENCE: 15 gacattgagc tcacccagtc tcca 24

<210> SEQ ID NO 16
<211> LENGTH: 22
<212> TYPE: DNA
<213> ORGANISM: Artificial Sequence
<220> FEATURE:
<223> OTHER INFORMATION: Description of Artificial Sequence:Primer

<400> SEQUENCE: 16 gttagatctc gagcttggtc cc 22

<210> SEQ ID NO 17
<211> LENGTH: 53
<212> TYPE: DNA
<213> ORGANISM: Artificial Sequence
<220> FEATURE:
<223> OTHER INFORMATION: Description of Artificial Sequence:Primer

<400> SEQUENCE: 17

-continued aacagttaag cttccgcttg cggccgcgga gctggggtct tcgctgtggt gcg 53

<210> SEQ ID NO 18
<211> LENGTH: 53
<212> TYPE: DNA
<213> ORGANISM: Artificial Sequence
<220> FEATURE:
<223> OTHER INFORMATION: Description of Artificial Sequence:Primer

<400> SEQUENCE: 18 aacagttaag cttccgcttg cggccgctgg ttgtggtttt ggtgtcttgg gtt 53

<210> SEQ ID NO 19
<211> LENGTH: 22
<212> TYPE: DNA
<213> ORGANISM: Artificial Sequence
<220> FEATURE:
<223> OTHER INFORMATION: Description of Artificial Sequence:Primer

<400> SEQUENCE: 19 aggtsmarct gcagsagtcw gg 22

<210> SEQ ID NO 20
<211> LENGTH: 30
<212> TYPE: DNA
<213> ORGANISM: Artificial Sequence
<220> FEATURE:
<223> OTHER INFORMATION: Description of Artificial Sequence:Primer

<400> SEQUENCE: 20 tcctgaggag acggtgacct gggtcccctg 30

<210> SEQ ID NO 21
<211> LENGTH: 29
<212> TYPE: DNA
<213> ORGANISM: Artificial Sequence
<220> FEATURE:
<223> OTHER INFORMATION: Description of Artificial Sequence:Primer

<400> SEQUENCE: 21 gtcaccgtct cctcacaggt gcagctgca 29

<210> SEQ ID NO 22
<211> LENGTH: 20
<212> TYPE: DNA
<213> ORGANISM: Artificial Sequence
<220> FEATURE:
<223> OTHER INFORMATION: Description of Artificial Sequence:Primer

<400> SEQUENCE: 22 gcagaggagt gtccacgtcg 20

<210> SEQ ID NO 23
<211> LENGTH: 21
<212> TYPE: DNA
<213> ORGANISM: Artificial Sequence
<220> FEATURE:
<223> OTHER INFORMATION: Description of Artificial Sequence:Primer

<400> SEQUENCE: 23 gcaaatggca ttctgacatc c 21

<210> SEQ ID NO 24
<211> LENGTH: 21
<212> TYPE: DNA
<213> ORGANISM: Artificial Sequence -continued <220> FEATURE:
<223> OTHER INFORMATION: Description of Artificial Sequence:Primer

<400> SEQUENCE: 24 tactattgcc agcattgctg c 21

<210> SEQ ID NO 25
<211> LENGTH: 999
<212> TYPE: DNA
<213> ORGANISM: Artificial Sequence
<220> FEATURE:
<223> OTHER INFORMATION: Description of Artificial Sequence:Primer

<400> SEQUENCE: 25 aagcttgcat gcaaattcta tttcaaggag acagtcataa tgaaatacct attgcctacg 60 gcagccgctg gattgttatt actcgctgcc caaccagcga tggcccaggt gcagctgcag 120 gagtcagggg gagacttagt gaagcctgga gggtccctga cactctcctg tgcaacctct 180 ggattcactt tcagtagtta tgccttttct tgggtccgcc agacctcaga caagagtctg 240 gagtgggtcg caaccatcag tagtactgat acttatacct attattcaga caatgtgaag 300 gggcgcttca ccatctccag agacaatggc aagaacaccc tgtacctgca aatgagcagt 360 ctgaagtctg aggacacagc cgtgtattac tgtgcaagac atgggtacta tggtaaaggc 420 tattttgact actggggcca agggaccacg gtcaccgtct cctcataata agagctatgg 480 gagcttgcat gcaaattcta tttcaaggag acagtcataa tgaaatacct attgcctacg 540 gcagccgctg gattgttatt actcgctgcc caaccagcga tggccgacat cgagctcact 600 cagtctccat tctccctgac tgtgacagca ggagagaagg tcactatgaa ttgcaagtcc 660 ggtcagagtc tgttaaacag tgtaaatcag aggaactact tgacctggta ccagcagaag 720 ccagggcagc ctcctaaact gttgatctac tgggcatcca ctagggaatc tggagtccct 780 gatcgcttca cagccagtgg atctggaaca gatttcactc tcaccatcag cagtgtgcag 840 gctgaagacc tggcagttta ttactgtcag aatgattata cttatccgtt cacgttcgga 900 ggggggacca agctcgagat caaacgggaa caaaaactca tctcagaaga ggatctgaat 960 taataagatc aaacggtaat aaggatccag ctcgaattc 999

<210> SEQ ID NO 26
<211> LENGTH: 924
<212> TYPE: DNA
<213> ORGANISM: Artificial Sequence
<220> FEATURE:
<223> OTHER INFORMATION: Description of Artificial Sequence:Primer

<400> SEQUENCE: 26 aagcttgcat gcaaattcta tttcaaggag acagtcataa tgaaatacct attgcctacg 60 gcagccgctg gattgttatt actcgctgcc caaccagcga tggcccaggt gcagctgcag 120 gagtcagggg gagacttagt gaagcctgga gggtccctga cactctcctg tgcaacctct 180 ggattcactt tcagtagtta tgccttttct tgggtccgcc agacctcaga caagagtctg 240 gagtgggtcg caaccatcag tagtactgat acttatacct attattcaga caatgtgaag 300 gggcgcttca ccatctccag agacaatggc aagaacaccc tgtacctgca aatgagcagt 360 ctgaagtctg aggacacagc cgtgtattac tgtgcaagac atgggtacta tggtaaaggc 420 tattttgact actggggcca agggaccacg gtcaccgtct cctcaggtgg aggcggttca 480 ggcggaggtg gctctggcgg tggcggatcg gacatcgagc tcactcagtc tccattctcc 540

-continued

```
ctgactgtga cagcaggaga gaaggtcact atgaattgca agtccggtca gagtctgtta    600

aacagtgtaa atcagaggaa ctacttgacc tggtaccagc agaagccagg gcagcctcct    660

aaactgttga tctactgggc atccactagg gaatctggag tccctgatcg cttcacagcc    720

agtggatctg gaacagattt cactctcacc atcagcagtg tgcaggctga agacctggca    780

gtttattact gtcagaatga ttatacttat ccgttcacgt tcggaggggg gaccaagctc    840

gagatcaaac gggaacaaaa actcatctca gaagaggatc tgaattaata agatcaaacg    900

gtaataagga tccagctcga attc                                           924
```

<210> SEQ ID NO 27
<211> LENGTH: 996
<212> TYPE: DNA
<213> ORGANISM: Artificial Sequence
<220> FEATURE:
<223> OTHER INFORMATION: Description of Artificial Sequence:Primer

<400> SEQUENCE: 27

```
aagcttgcat gcaaattcta tttcaaggag acagtcataa tgaaatacct attgcctacg     60

gcagccgctg gattgttatt actcgctgcc caaccggcca tggcccaggt gcagctgcag    120

cagtctgggg ctgaactggt gaagcctggg ccttctgtga agctgtcctg caaggcttcc    180

gactacacct tcaccagtta ttggatgcac tgggtgaagc agaggcctgg acaaggcctt    240

gagtggattg gagagattaa tcctaccaac ggtcgtactt attacaatga gaagttcaag    300

agcaaggcca cactgactgt agacaaatct tccagtacag cctacatgca gctcagcagc    360

ctgacatctg aggactctgc ggtctattac tgtgcaagac ggtatggtaa ctcctttgac    420

tactggggcc aagggaccac ggtcaccgtc tcctcataat aagagctatg ggagcttgca    480

tgcaaattct atttcaagga gacagtcata atgaaatacc tattgcctac ggcagccgct    540

ggattgttat tactcgctgc ccaaccagcg atggccgaca tcgagctcac ccagtctcca    600

gattctttgg ctgtgtctct agggcagagg gccaccatat cctgcagagc cagtgaaagt    660

gttgatagtt atggcaatag ttttatgcag tggtaccagc agaaaccagg acagccaccc    720

aaactcctca tctatcgtgc atccaaccta gaatctggga ttcctgccag gttcagtggc    780

actgggtcta ggacagactt caccctcacc attaatcctg tggaggctga tgatgttgca    840

acctattatt gtcaacaaag tgatgagtat ccgtacatgt acacgttcgg agggggggacc    900

aagctcgaga tcaaacgggg atccggtagc gggaactccg gtaaggggta cctgaagtaa    960

taagatcaaa cggtaataag gatccagctc gaattc                              996
```

<210> SEQ ID NO 28
<211> LENGTH: 920
<212> TYPE: DNA
<213> ORGANISM: Artificial Sequence
<220> FEATURE:
<223> OTHER INFORMATION: Description of Artificial Sequence:Primer

<400> SEQUENCE: 28

```
aagcttgcaa attctatttc aaggagacag tcataatgaa atacctattg cctacggcag     60

ccgctggatt gttattactc gctgcccaac cagcgatggc ccaggtgcag ctgcagcagt    120

caggacctga gctggtaaag cctggggctt cagtgaagat gtcctgcaag gcttctggat    180

acacattcac tagctatgtt atgcactggg tgaaacagaa gcctgggcag ggccttgagt    240

ggattggata tatttatcct tacaatgatg gtactaagta caatgagaag ttcaaaggca    300

aggccacact gacttcagac aaatcctcca gcacagccta catggagctc agcagcctga    360
```

-continued

```
cctctgagga ctctgcggtc tattactgtt caagacgctt tgactactgg ggccaaggga    420

ccacggtcac cgtctcctca taataagagc tatgggagct tgcatgcaaa ttctatttca    480

aggagacagt cataatgaaa tacctattgc ctacggcagc cgctggattg ttattactcg    540

ctgcccaacc agcgatggcc gacatcgagc tcacccagtc tccatcttcc atgtatgcat    600

ctctaggaga gagaatcact atcacttgca aggcgagtca ggacattaat acctatttaa    660

cctggttcca gcagaaacca gggaaatctc ccaagaccct gatctatcgt gcaaacagat    720

tgctagatgg ggtcccatca aggttcagtg gcagtggatc tgggcaagat tattctctca    780

ccatcagcag cctggactat gaagatatgg gaatttatta ttgtctacaa tatgatgagt    840

tgtacacgtt cggagggggg accaagctcg agatcaaacg gtaataatga tcaaacggta    900

taaggatcca gctcgaattc                                                920
```

<210> SEQ ID NO 29
<211> LENGTH: 734
<212> TYPE: DNA
<213> ORGANISM: Artificial Sequence
<220> FEATURE:
<223> OTHER INFORMATION: Description of Artificial Sequence:Primer

<400> SEQUENCE: 29

```
gaattcggcc gacatcgagc tcacccagtc tccagcctcc ctttctgcgt ctgtgggaga     60

aactgtcacc atcacatgtc gagcaagtgg gaatattcac aattatttag catggtatca    120

gcagaaacag ggaaaatctc ctcagctcct ggtctattat acaacaacct tagcagatgg    180

tgtgccatca aggttcagtg gcagtggatc aggaacacaa tattctctca agatcaacag    240

cctgcaacct gaagattttg ggagttatta ctgtcaacat ttttggagta ctcctcggac    300

gttcggtgga accaagctcg agatcaaacg gggtggaggc ggttcaggcg gaggtggctc    360

tggcggtggc ggatcgcagg tgcagctgca ggagtcagga cctggcctgg tggcgccctc    420

acagagcctg tccatcacat gcaccgtctc agggttctca ttaaccggct atggtgtaaa    480

ctgggttcgc cagcctccag gaaagggtct ggagtggctg ggaatgattt ggggtgatgg    540

aaacacagac tataattcag ctctcaaatc cagactgagc atcagcaagg acaactccaa    600

gagccaagtt ttcttaaaaa tgaacagtct gcacactgat gacacagcca ggtactactg    660

tgccagagag agagattata ggcttgacta ctggggccaa gggaccacgg tcaccgtctc    720

ctcatgataa gctt                                                      734
```

<210> SEQ ID NO 30
<211> LENGTH: 265
<212> TYPE: PRT
<213> ORGANISM: Artificial Sequence
<220> FEATURE:
<223> OTHER INFORMATION: Description of Artificial Sequence:Primer

<400> SEQUENCE: 30

```
Gln Val Gln Leu Gln Glu Ser Gly Gly Gly Leu Val Gln Ala Gly Gly
  1               5                  10                  15

Ser Leu Arg Leu Ser Cys Ala Ala Ser Gly Phe Thr Phe Ser Thr His
             20                  25                  30

Ser Leu Gly Trp Phe Arg Gln Ala Pro Gly Lys Glu Arg Asp Val Val
         35                  40                  45

Ala Ala Ile Ser Trp Ser Gly Ala Ser Gln Phe Tyr Glu Asp Ser Val
     50                  55                  60
```

-continued

```
Lys Gly Arg Phe Thr Ile Ser Arg Asp Asn Ala Lys Asn Thr Val Tyr
 65                  70                  75                  80

Leu Gln Met Asn Ser Leu Lys Pro Glu Asp Thr Ala Val Tyr Tyr Cys
                 85                  90                  95

Ala Ala Arg Leu Gly Thr Ile Thr Ser Ser Thr Tyr Tyr Ser Arg Pro
            100                 105                 110

Pro Tyr Lys Tyr Trp Gly Gln Gly Thr Gln Val Thr Val Ser Ser Gln
        115                 120                 125

Val Gln Leu Gln Glu Ser Gly Gly Glu Leu Val Gln Pro Gly Gly Ser
    130                 135                 140

Leu Lys Leu Phe Cys Ala Ala Ser Gly Leu Thr Phe Ile Asn Tyr Ser
145                 150                 155                 160

Met Gly Trp Phe Arg Gln Ala Pro Gly Val Asp Arg Glu Ala Val Ala
                165                 170                 175

Ala Ile Ser Trp Gly Asp Asn Thr Tyr Tyr Val Ser Ser Val Lys Gly
            180                 185                 190

Arg Phe Thr Ile Ser Arg Asp Asn Ala Lys Asn Ile Val Tyr Leu Gln
        195                 200                 205

Met Asn Ser Leu Lys Arg Pro Gln Asp Thr Ala Val Tyr Tyr Cys Ala
    210                 215                 220

Val Lys Arg Asp Asp Gly Trp Trp Asp Tyr Trp Gly Gln Gly Thr Gln
225                 230                 235                 240

Val Ile Val Ser Ser Gly Ser His His His His His His Arg Ser Gly
                245                 250                 255

Ser Gly Asn Gly Lys Gly Tyr Leu Lys
            260                 265


<210> SEQ ID NO 31
<211> LENGTH: 260
<212> TYPE: PRT
<213> ORGANISM: Artificial Sequence
<220> FEATURE:
<223> OTHER INFORMATION: Description of Artificial Sequence:Primer

<400> SEQUENCE: 31

Gln Val Gln Leu Gln Glu Ser Gly Gly Gly Leu Val Gln Ala Gly Gly
  1               5                  10                  15

Ser Leu Arg Leu Ser Cys Ala Ala Ser Gly Phe Thr Phe Ser Thr His
             20                  25                  30

Ser Leu Gly Trp Phe Arg Gln Ala Pro Gly Lys Glu Arg Asp Val Val
         35                  40                  45

Ala Ala Ile Ser Trp Ser Gly Ala Ser Gln Phe Tyr Glu Asp Ser Val
     50                  55                  60

Lys Gly Arg Phe Thr Ile Ser Arg Asp Asn Ala Lys Asn Thr Val Tyr
 65                  70                  75                  80

Leu Gln Met Asn Ser Leu Lys Pro Glu Asp Thr Ala Val Tyr Tyr Cys
                 85                  90                  95

Ala Ala Arg Leu Gly Thr Ile Thr Ser Ser Thr Tyr Tyr Ser Arg Pro
            100                 105                 110

Pro Tyr Lys Tyr Trp Gly Gln Gly Thr Gln Val Thr Val Ser Ser Gln
        115                 120                 125

Val Gln Leu Gln Glu Ser Gly Gly Glu Leu Val Gln Ala Gly Glu Ser
    130                 135                 140

Leu Arg Leu Ser Cys Ala Ala Ser Gly Arg Ser Phe Ser Ser Asp Val
145                 150                 155                 160
```

-continued

```
Met Gly Trp Phe Arg Gln Ala Pro Gly Lys Glu Arg Glu Phe Val Ala
                165                 170                 175

Ala Ser Ser Trp Asn Gly Gly Thr His Tyr Ser Asp Ser Val Lys Gly
            180                 185                 190

Arg Phe Thr Ile Ser Arg Asp Ile Ala Lys Asn Thr Leu Gln Met Asn
        195                 200                 205

Ser Leu Lys Pro Glu Asp Thr Ala Val Tyr Tyr Cys Arg Trp Gly Arg
    210                 215                 220

Pro Pro Arg Asn Tyr Trp Gly Gln Gly Thr Gln Val Ile Val Ser Ser
225                 230                 235                 240

Gly Ser His His His His His His Arg Ser Gly Ser Gly Asn Gly Lys
                245                 250                 255

Gly Tyr Leu Lys
            260


<210> SEQ ID NO 32
<211> LENGTH: 260
<212> TYPE: PRT
<213> ORGANISM: Artificial Sequence
<220> FEATURE:
<223> OTHER INFORMATION: Description of Artificial Sequence:Primer

<400> SEQUENCE: 32

Gln Val Gln Leu Gln Glu Ser Gly Gly Gly Leu Val Gln Ala Gly Gly
  1               5                  10                  15

Ser Leu Arg Leu Ser Cys Ala Val Ser Gly Arg Thr Phe Ser Thr Tyr
             20                  25                  30

Ala Val Gly Trp Phe Arg Gln Ala Pro Gly Lys Glu Arg Glu Phe Val
         35                  40                  45

Ala Ala Ile Ser Trp Ser Gly Ser Thr Tyr Tyr Glu Asp Ala Val Lys
     50                  55                  60

Gly Arg Phe Thr Ile Ser Arg Asp Asn Ala Lys Asn Thr Val Tyr Leu
 65                  70                  75                  80

Gln Met Asn Ser Leu Lys Pro Glu Asp Thr Ala Val Tyr Tyr Cys Ala
                 85                  90                  95

Arg Arg Gly Arg Pro Gly Gln Ser Ser Ser Tyr Tyr Lys Asn Pro Ile
            100                 105                 110

Glu Tyr Glu Tyr Trp Gly Gln Gly Thr Gln Val Thr Val Ser Ser Gln
        115                 120                 125

Val Gln Leu Gln Glu Ser Gly Gly Glu Leu Val Gln Ala Gly Glu Ser
    130                 135                 140

Leu Arg Leu Ser Cys Ala Ala Ser Gly Arg Ser Phe Ser Ser Asp Val
145                 150                 155                 160

Met Gly Trp Phe Arg Gln Ala Pro Gly Lys Glu Arg Glu Phe Val Ala
                165                 170                 175

Ala Ser Ser Trp Asn Gly Gly Thr His Tyr Ser Asp Ser Val Lys Gly
            180                 185                 190

Arg Phe Thr Ile Ser Arg Asp Ile Ala Lys Asn Thr Leu Gln Met Asn
        195                 200                 205

Ser Leu Lys Pro Glu Asp Thr Ala Val Tyr Tyr Cys Arg Trp Gly Arg
    210                 215                 220

Pro Pro Arg Asn Tyr Trp Gly Gln Gly Thr Gln Val Ile Val Ser Ser
225                 230                 235                 240

Gly Ser His His His His His His Arg Ser Gly Ser Gly Asn Gly Lys
                245                 250                 255
```

-continued

Gly Tyr Leu Lys
260

<210> SEQ ID NO 33
<211> LENGTH: 259
<212> TYPE: PRT
<213> ORGANISM: Artificial Sequence
<220> FEATURE:
<223> OTHER INFORMATION: Description of Artificial Sequence:Primer

<400> SEQUENCE: 33

Gln Val Gln Leu Gln Glu Ser Gly Gly Gly Leu Val Gln Ala Gly Gly
1 5 10 15

Ser Leu Arg Leu Ser Cys Thr Ala Ser Gly Arg Ile Met Ser Asn Tyr
20 25 30

Gly Met Gly Trp Phe Arg Gln Ala Pro Gly Lys Glu Arg Glu Ser Val
35 40 45

Ala Ala Ile Ser Leu Ser Gly Gly Thr Thr Tyr Tyr Ala Asp Ala Val
50 55 60

Ser Val Lys Gly Arg Phe Thr Ile Ser Arg Asp Asn Ala Lys Asn Thr
65 70 75 80

Val Tyr Leu Glu Met Asn Ser Leu Lys Pro Ala Asp Thr Ala Val Tyr
85 90 95

Tyr Cys Ala Gly Asp Arg Thr Gly Arg Gly Ser Arg Leu Arg Tyr Asp
100 105 110

Tyr Thr Tyr Trp Gly Gln Gly Thr Gln Val Thr Val Ser Ser Gln Val
115 120 125

Gln Leu Gln Glu Ser Gly Gly Glu Leu Val Gln Ala Gly Glu Ser Leu
130 135 140

Arg Leu Ser Cys Ala Ala Ser Gly Arg Ser Phe Ser Ser Asp Val Met
145 150 155 160

Gly Trp Phe Arg Gln Ala Pro Gly Lys Glu Arg Glu Phe Val Ala Ala
165 170 175

Ser Ser Trp Asn Gly Gly Thr His Tyr Ser Asp Ser Val Lys Gly Arg
180 185 190

Phe Thr Ile Ser Arg Asp Ile Ala Lys Asn Thr Leu Gln Met Asn Ser
195 200 205

Leu Lys Pro Glu Asp Thr Ala Val Tyr Tyr Cys Arg Trp Gly Arg Pro
210 215 220

Pro Arg Asn Tyr Trp Gly Gln Gly Thr Gln Val Ile Val Ser Ser Gly
225 230 235 240

Ser His His His His His His Arg Ser Gly Ser Gly Asn Gly Lys Gly
245 250 255

Tyr Leu Lys

<210> SEQ ID NO 34
<211> LENGTH: 888
<212> TYPE: DNA
<213> ORGANISM: Artificial Sequence
<220> FEATURE:
<223> OTHER INFORMATION: Description of Artificial Sequence:Primer

<400> SEQUENCE: 34 caggtgcagc tgcaggagtc agggggagga ttggtgcagg ctgggggctc tctgagactc 60 tcctgtgcag cctcgggacg cgccaccagt ggtcatggtc actatggtat gggctggttc 120 cgccaggttc cagggaagga gcgtgagttt gtcgcagcta ttaggtggag tggtaaagag 180

-continued

```
acatggtata aagactccgt gaagggccga ttcaccatct ccagagataa cgccaagact    240

acggtttatc tgcaaatgaa cagcctgaaa cctgaagata cggccgttta ttattgtgcc    300

gctcgaccgg tccgcgtgga tgatatttcc ctgccggttg ggtttgacta ctggggccag    360

gggacccagg tcaccgtctc ctcacaggtg cagctgcagc agtctggggg aggcttggta    420

cagcctgggg ggtctctaag actctcctgt gaagcctctg ggttcatctt cagtagcaga    480

gcgatgtcct ggtatcgcca gggtccaggg aagcagcgcg agccggtcgc atttatttct    540

actggtggtg atacaaacta tgctaactcc gtgaagggcc gattcaccat ctccagagac    600

aacgccaaga acacggtaga tctgcaaatg aacaatttaa aacctgagga cacggccgtc    660

tattactgta agacaatagt cgaaaaggac tactggggcc aggggaacca ggtcaccgtc    720

tcctcaggat ctcatcacca tcaccatcac ggatccacct ccattgaagg tcgtacccag    780

tctcactacg gtcagtgtgg tggtattggt tactccggtc caaccgtctg tgcctctggt    840

accacctgtc aggttctgaa cccttactac tcccagtgtc tgtaataa                 888
```

What is claimed is:

1. A method of delivering a benefit agent to fabric for exerting a pre-determined activity, which comprises pre-treating said fabric with a multi-specific binding molecule, said binding molecule selected from the group consisting of an antibody, an antibody fragment, and a derivative thereof having a high binding affinity to said fabric through one specificity and is capable of scavenging and binding to said benefit agent through another specificity, followed by contacting said pre-treated fabric with said benefit agent to exert said pre-determined activity to said fabric.

2. The method of claim 1, wherein said area of a fabric comprises one or more stains, said pre-determined activity is bleaching activity, and said benefit agent is capable of generating a bleaching agent.

3. The method of claim 1, wherein said benefit agent is an enzyme or enzyme part capable of catalyzing the formation of a bleaching agent.

4. The method of claim 1, wherein said benefit agent is an oxidase or haloperoxidase or functional part thereof.

5. The method of claim 1, wherein said benefit agent is an oxidase is selected from the group consisting of glucose oxidase, galactose oxidase and alcohol oxidase.

6. The method of claim 1, wherein said benefit agent is a chloroperoxidase.

7. The method of claim 1, wherein said benefit agent is a vanadium chloroperoxidase.

8. The method of claim 1, wherein said benefit agent is a *Curvularia inaequalis* chloroperoxidase.

9. The method of claim 1, wherein said benefit agent is a bleaching agent selected from the group consisting of hydrogen peroxide and a hypohalite.

10. The method of claim 2, wherein said enzyme part is a laccase or a peroxidase and said bleaching agent is derived from an enhancer molecule that has reacted with the enzyme.

11. A method of delivering a benefit agent to fabric for exerting a pre-determined activity, which comprises pre-treating said fabric with a multi-specific binding molecule, said binding molecule selected from the group consisting of an antibody, an antibody fragment, and a derivative thereof having a high binding affinity to said fabric through one specificity and is capable of scavenging and binding to said benefit agent through another specificity, followed by contacting said pre-treated fabric with said benefit agent to exert said pre-determined activity to said fabric wherein said benefit agent is an enzyme or enzyme part, whereby said enzyme part is bound to said binding molecule having a high binding affinity for porphyrin derived structures, tannins, polyphenols, carotenoids, anthocyanins, and Maillard reaction products.

12. The method of claim 1, wherein said benefit agent is an enzyme or enzyme part, whereby said enzyme part is bound to said binding molecule having a high binding affinity for porphyrin derived structures, tannins, polyphenols, carotenoids, anthocyanins, and Maillard reaction products when they are adsorbed onto the surface of a fabric.

13. The method of claim 1, wherein the fabric is cotton, polyester, polyester/cotton, or wool.

14. The method of claim 1, wherein said binding molecule is an antibody or antibody fragment or derivative thereof, which is all of part of a heavy chain immunoglobulin that was raised in Camelidae and has a specificity for stain molecules.

15. The method of claim 1, wherein said binding molecule is an antibody or antibody fragment or derivative thereof capable of binding to chemical constituents which are present in tea, blackberry and red wine including non-pigmented components of stains.

16. The method of claim 1, wherein the binding molecule having a high binding affinity has a chemical equilibrium constant $K_d$ for the substance of less than $10^{-4}$ M.

17. The method of claim 1, wherein the binding molecule having a high binding affinity has a chemical equilibrium constant $K_d$ is less than $10^{-7}$ M.

18. The method of claim 1, wherein said benefit agent is selected from the group consisting of fragrance agents, perfumes, colour enhancers, fabric softening agents, polymeric lubricants, photoprotective agents, latexes, resins, dye fixative agents, encapsulated materials, antioxidants, insecticides, anti-microbial agents, soil repelling agents, soil release agents, and cellulose fiber repair agents.

19. The method of claim 1, wherein said benefit agent is comprised in an aqueous solution.

20. The method of claim 9, wherein said bleaching agent is a hypochlorite.

21. A method of delivering a benefit agent to fabric for exerting a pre-determined activity, which comprises pre-treating said fabric with a multi-specific binding molecule, said binding molecule selected from the group consisting of an antibody, an antibody fragment, and a derivative thereof having a high binding affinity to said fabric through one specificity and is capable of scavenging and binding to said benefit agent through another specificity, followed by contacting said pre-treated fabric with said benefit agent to exert said pre-determined activity to said fabric wherein the binding molecule having a high binding affinity has a chemical equilibrium constant $K_d$ for the substance of less than $10^{-6}$ M.

* * * * *